US011413658B2

(12) United States Patent
Gibson et al.

(10) Patent No.: US 11,413,658 B2
(45) Date of Patent: Aug. 16, 2022

(54) SYSTEM AND A METHOD FOR SORTING VENEER SHEETS

(71) Applicant: RAUTE OYJ, Nastola (FI)

(72) Inventors: Peter William Gibson, Surrey (CA); Andrew Edward Smith, Surrey (CA); Stefan Muresan, New Westminster (CA); Jeffrey Michael Webber, Surrey (CA)

(73) Assignee: RAUTE OYJ, Nastola (FI)

( * ) Notice: Subject to any disclaimer, the term of this patent is extended or adjusted under 35 U.S.C. 154(b) by 329 days.

(21) Appl. No.: 16/844,768

(22) Filed: Apr. 9, 2020

(65) Prior Publication Data

US 2021/0316336 A1 Oct. 14, 2021

(51) Int. Cl.

| | |
|---|---|
| ***B07C 5/34*** | (2006.01) |
| ***B07C 5/36*** | (2006.01) |
| ***B65H 39/10*** | (2006.01) |
| ***B07C 5/08*** | (2006.01) |
| ***B65H 3/08*** | (2006.01) |

(52) U.S. Cl.

CPC ..... *B07C 5/362* (2013.01); *B07C 5/083* (2013.01); *B07C 5/34* (2013.01); *B65H 3/0816* (2013.01); *B65H 3/0891* (2013.01); *B65H 39/10* (2013.01); *B07C 2501/0063* (2013.01); *B65H 2408/1143* (2013.01); *B65H 2701/5116* (2013.01)

(58) Field of Classification Search

CPC ... B65H 2701/1938; B07C 5/14; B07C 5/083; B07C 5/362; B07C 5/34

See application file for complete search history.

(56) References Cited

U.S. PATENT DOCUMENTS 2,846,086 A * 8/1958 Norwood ..... B07C 5/14 414/789.9
3,227,275 A * 1/1966 Cody ..... B27D 5/00 198/689.1

(Continued)

FOREIGN PATENT DOCUMENTS

CN 107655975 A * 2/2018

*Primary Examiner* — Patrick H Mackey

(74) *Attorney, Agent, or Firm* — Thomas | Horstemeyer, LLP

(57) ABSTRACT

The invention relates to a system for sorting veneer sheets. The system comprises: an assembly section; a reject section; a feeding section arranged between the assembly section and the reject section; at least one detection device configured to scan a top surface of a topmost veneer sheet of a stack of veneer sheets to provide a plurality of successive scan lines images; at least two parallel transfer devices; and a control system. The control system is configured to provide a surface scan image from the plurality of successive scan lines images, determine one or more properties of the veneer sheet based on the surface scan image, and to control the at least two transfer devices to: move from an avoidance position to a pick-up position determined based on the surface scan image; pick up the topmost veneer sheet of the stack of veneer sheets; and transfer the picked-up veneer sheet to the assembly section in response to detecting that each of the determined one or more properties of the veneer sheet meets a respective predetermined criterion, or otherwise transfer the picked-up veneer sheet to the reject section. The invention relates also to a method for sorting veneer sheets.

20 Claims, 11 Drawing Sheets

(56) References Cited

U.S. PATENT DOCUMENTS

| | | | | | |
|---|---|---|---|---|---|
| 3,417,989 | A * | 12/1968 | Haselow | B26D 1/205 | 271/302 |
| 3,508,648 | A * | 4/1970 | Stickney | B65H 31/24 | 271/305 |
| 3,545,744 | A * | 12/1970 | Herman | B27L 5/002 | 271/189 |
| 3,717,249 | A * | 2/1973 | Faley | B65H 31/24 | 209/555 |
| 3,812,964 | A * | 5/1974 | Woodruff | B07C 5/14 | 209/555 |
| 3,894,625 | A * | 7/1975 | Boyle | B65G 47/44 | 198/395 |
| 3,912,254 | A * | 10/1975 | Woodruff | B07C 5/14 | 271/189 |
| 5,524,771 | A * | 6/1996 | Kairi | B27D 1/04 | 209/567 |
| 5,573,121 | A * | 11/1996 | McKay | B07C 5/362 | 209/521 |
| 2020/0238528 | A1 * | 7/2020 | Takeda | B21D 43/021 | |

* cited by examiner

SYSTEM AND A METHOD FOR SORTING VENEER SHEETS

TECHNICAL FIELD

The invention concerns in general the technical field of manufacturing of wood products. Especially the invention concerns sorting of veneer sheet products.

BACKGROUND

Manufacturing of wood products is a process comprising of a plurality of stages. Typically, there may be several stages in the manufacturing process of the wood products and other products, wherein the products need to be transferred from one place to another. The products may typically be sheet-like products, such as paper, plasterboard, or veneer sheets. In the following it is mainly referred to veneer sheets. Veneers may be used in plywood or laminated veneer lumber manufacturing processes.

For example, one or more veneer sheets may be transferred with one or more suction-based transfer devices from a stack of veneer sheets to another location, such as to another stack of veneers or to a conveyor device to transferring the veneer sheets for further stages of the process. The veneer sheets to be transferred may be picked-up one by one from the stack with the transfer devices and transferred to a desired location. The transfer devices may comprise a plurality of suction devices, such as cups or nozzles, arranged in one or more rows for gripping by suction to the top surface of the veneer sheet to be transferred.

The stack of veneer sheets may comprise different size and randomly oriented veneer sheets, which may cause problems in the transferring the veneer sheets with the transfer devices, e.g. dropping of the veneer sheet, transferring more than one veneer sheet at a time, etc. Thus, the size and/or orientation of the veneer sheet to be transferred may typically be defined before transferring the veneer sheet. In order to detect the size and/or the orientation of the veneer sheet to be transferred with the one or more suction-based transfer devices at least a part of the top surface of the veneer sheet to be transferred may be imaged with an inspection device, such as a camera. The transfer devices may then pick-up the veneer sheet to be transferred in accordance with the detected size and/or the detected orientation of the veneer sheet.

However, there is need to develop alternative solutions for sorting the veneer sheets.

SUMMARY

The following presents a simplified summary in order to provide basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

An objective of the invention is to present a system and a method for sorting veneer sheets. Another objective of the invention is that the system and the method for sorting veneer sheets improve at least partly scanning and/or transferring of the veneers sheets.

The objectives of the invention are reached by a system and a method as defined by the respective independent claims.

According to a first aspect, a system for sorting veneer sheets is provided, wherein the system comprises: an assembly section for handling accepted veneer sheets; a reject section for handling rejected veneer sheets; a feeding section comprising a feeding hoisting device configured to receive a stack of veneer sheets and to adjust the height of the stack of veneer sheets in the vertical direction so that the top surface of the topmost veneer sheet of the stack is at a scanning height, wherein the feeding section is arranged between the assembly section and the reject section; at least one detection device configured to scan the top surface of the topmost veneer sheet of the stack of veneer sheets to provide a plurality of successive scan lines of the top surface of the topmost veneer sheet while moving over the stack of veneer sheets in the horizontal direction between the assembly section side of the feeding section and the reject section side of the feeding section; at least two parallel transfer devices for transferring the topmost veneer sheet from the stack of veneer sheets to the assembly section or to the reject section; and a control system configured to provide a surface scan image from the plurality of successive scan lines provided by the at least one detection device, determine one or more properties of the veneer sheet based on the surface scan image, and to control the at least two transfer devices to: move from an avoidance position to a pick-up position determined based on the surface scan image, wherein the avoidance position is a position, where the at least two transfer devices are away from a scanning path of the at least one detection device; pick up the topmost veneer sheet of the stack of veneer sheets; and transfer the picked-up veneer sheet to the assembly section in response to detecting that each of the determined one or more properties of the veneer sheet meets a respective predetermined criterion, or otherwise transfer the picked-up veneer sheet to the reject section.

Each of the at least two transfer devices may comprise a plurality of suction devices configured to grip to the top surface of the veneer sheet to be transferred by activating one or more of the plurality of suction devices, wherein the control system may be configured to control activation and/or deactivation of each of the plurality of the suction devices individually or the plurality of the suction devices in one or more groups.

Alternatively or in addition, an individual pick-up position, an individual release position, and/or an individual transfer distance may be determined for each of the at least two transfer devices on the basis of the surface scan image so that the picked-up veneer sheet may be aligned to desired orientation.

Alternatively or in addition, the at least one detection device may be configured to scan the subsequent topmost veneer sheet of the stack while the at least two transfer devices are transferring the previous topmost veneer sheet to the reject section or to the assembly section, wherein a scanning direction of a subsequent topmost veneer sheet may depend on the direction to which the at least two transfer devices are configured to move to transfer the previous topmost veneer sheet.

Alternatively or in addition, the scanning by the at least one detection device may start outside an edge of the veneer sheet and end outside the opposite edge of the veneer sheet.

Alternatively or in addition, the system may further comprise one or more sensor devices configured to obtain data to determine that the top surface of the topmost veneer sheet of the stack is at the scanning height and/or to determine whether the pick-up of the veneer sheet is successful or not.

Alternatively or in addition, the one or more properties of the veneer sheet may comprise: length of the veneer sheet; width of the veneer sheet; and/or number, size, and/or form of defects in the veneer sheet.

Alternatively or in addition, the system may further comprise a plurality of accumulator forks arranged in parallel above a reject hoisting device of the reject section and configured to receive the veneer sheets transferred to the reject section.

Before receiving the reject veneer sheets by the plurality of accumulator forks and in response to a determination that a predetermined amount of reject veneer sheets is already transferred to the plurality of accumulator forks, the plurality of accumulator forks may be configured to: slide from the reject section to the feeding section causing that the rejected veneer sheets are cleared off from the plurality of accumulator forks onto the reject hoisting device, and slide, from the feeding section back to the reject section to receive the veneer sheets transferred to the reject section.

Alternatively or in addition, the plurality of accumulator forks may be configured to: slide from the reject section to the feeding section, when the amount of the veneer sheets on the feeding hoisting device is less than a predefined limit, causing that the rejected veneer sheets are cleared off from the plurality of accumulator forks onto the reject hoisting device; and receive the remaining stack of veneer sheets from the feeding hoisting device, wherein the feeding hoisting device may be configured to receive a new stack of veneer sheets, while the plurality of accumulator forks is configured to support the stack of veneer sheets to feed the veneer sheets to be sorted.

According to a second aspect, a method for sorting veneer sheets is provided, wherein the method comprises: adjusting, by a feeding hoisting device of a feeding section, height of a stack of veneer sheets in the vertical direction so that the top surface of the topmost veneer sheet of the stack is at a scanning height; scanning, by at least one detection device, the top surface of the topmost veneer sheet of the stack of veneer sheets to provide a plurality of successive scan lines of the top surface of the topmost veneer sheet while moving over the stack of veneer sheets in the horizontal direction between the assembly section side of the feeding section and the reject section side of the feeding section; providing, by a control system, a surface scan image from the plurality of successive scan lines provided by the at least one detection device; determining, by the control system, one or more properties of the veneer sheet based on the surface scan image; and controlling, by the control system, the at least two transfer devices to: move from an avoidance position to a pick-up position determined based on the surface scan image, wherein the avoidance position is a position, where the at least two transfer devices are away from a scanning path of the at least one detection device; pick up the topmost veneer sheet of the stack of veneer sheets; and transfer the picked-up veneer sheet to the assembly section in response to detecting that each of the determined one or more properties of the veneer sheet meets a respective predetermined criterion, or otherwise transfer the picked-up veneer sheet to the reject section.

Each of the at least two transfer devices may comprise a plurality of suction devices configured to grip to the top surface of the veneer sheet to be transferred by activating one or more of the plurality of suction devices, wherein the method may further comprise controlling, by the control system, activation and/or deactivation of each of the plurality of the suction devices individually or the plurality of the suction devices in one or more groups.

Alternatively or addition, the method may further comprise determining, by the control system, an individual pick-up position, an individual release position, and/or an individual transfer distance for each of the at least two transfer devices on the basis of the surface scan image so that the picked-up veneer sheet may be aligned to desired orientation.

Alternatively or addition, the method may further comprise scanning, by the at least one detection device, the subsequent topmost veneer sheet of the stack while the at least two transfer devices are transferring the previous topmost veneer sheet to the reject section or to the assembly section, and wherein a scanning direction of a subsequent topmost veneer sheet may depend on the direction to which the at least two transfer devices are configured to move to transfer the previous topmost veneer sheet.

Alternatively or addition, the scanning by the at least one detection device may start outside an edge of the veneer sheet and end outside the opposite edge of the veneer sheet.

Alternatively or addition, the method may further comprise obtaining, by one or more sensor devices, data to determine that the top surface of the topmost veneer sheet of the stack is at the scanning height and/or determining, by one or more sensor devices, whether the pick-up of the veneer sheet is successful or not.

Alternatively or addition, the one or more properties of the veneer sheet may comprise: length of the veneer sheet; width of the veneer sheet; and/or number size, and/or form of defects in the veneer sheet.

Alternatively or addition, the method may further comprise: receiving, by a plurality of accumulator forks arranged in parallel above a reject hoisting device of the reject section, the veneer sheets transferred to the reject section.

Before receiving the reject veneer sheets by the plurality of accumulator forks and in response to a determination that a predetermined amount of reject veneer sheets is already transferred to the plurality of accumulator forks, the method may further comprise: sliding, by the plurality of accumulator forks, from the reject section to the feeding section causing that the rejected veneer sheets are cleared off from the plurality of accumulator forks onto the reject hoisting device, and sliding, by the plurality of accumulator forks, from the feeding section back to the reject section to receive the veneer sheets transferred to the reject section.

Alternatively or in addition, the method may further comprise: sliding, by the plurality of accumulator forks, from the reject section to the feeding section, when the amount of the veneer sheets on the feeding hoisting device is less than a predefined limit, causing that the rejected veneer sheets are cleared off from the plurality of accumulator forks onto the reject hoisting device; receiving, by the plurality of accumulator forks, the remaining stack of veneer sheets from the feeding hoisting device; and receiving, by the feeding hoisting device, a new stack of veneer sheets while the plurality of accumulator forks supports the stack of veneer sheets to feed the veneer sheets to be sorted.

Various exemplifying and non-limiting embodiments of the invention both as to constructions and to methods of operation, together with additional objects and advantages thereof, will be best understood from the following description of specific exemplifying and non-limiting embodiments when read in connection with the accompanying drawings.

The verbs "to comprise" and "to include" are used in this document as open limitations that neither exclude nor require the existence of unrecited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF FIGURES

The embodiments of the invention are illustrated by way of example, and not by way of limitation, in the figures of the accompanying drawings.

DESCRIPTION OF THE EXEMPLIFYING EMBODIMENTS

Figure 1A:
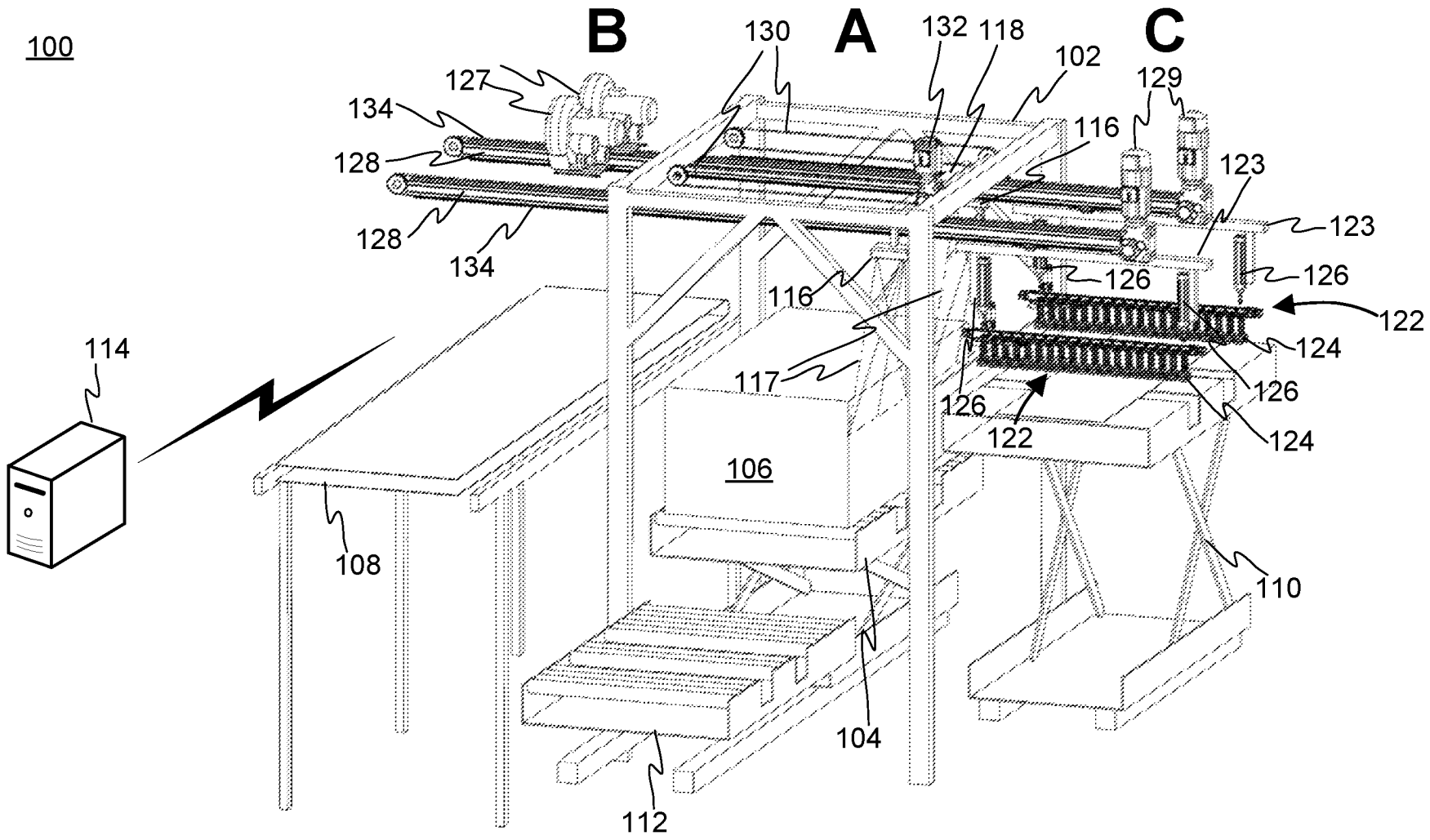
FIGS. 1A-1D illustrate schematically different views of an example of a system according to the invention.
Figure 1B:
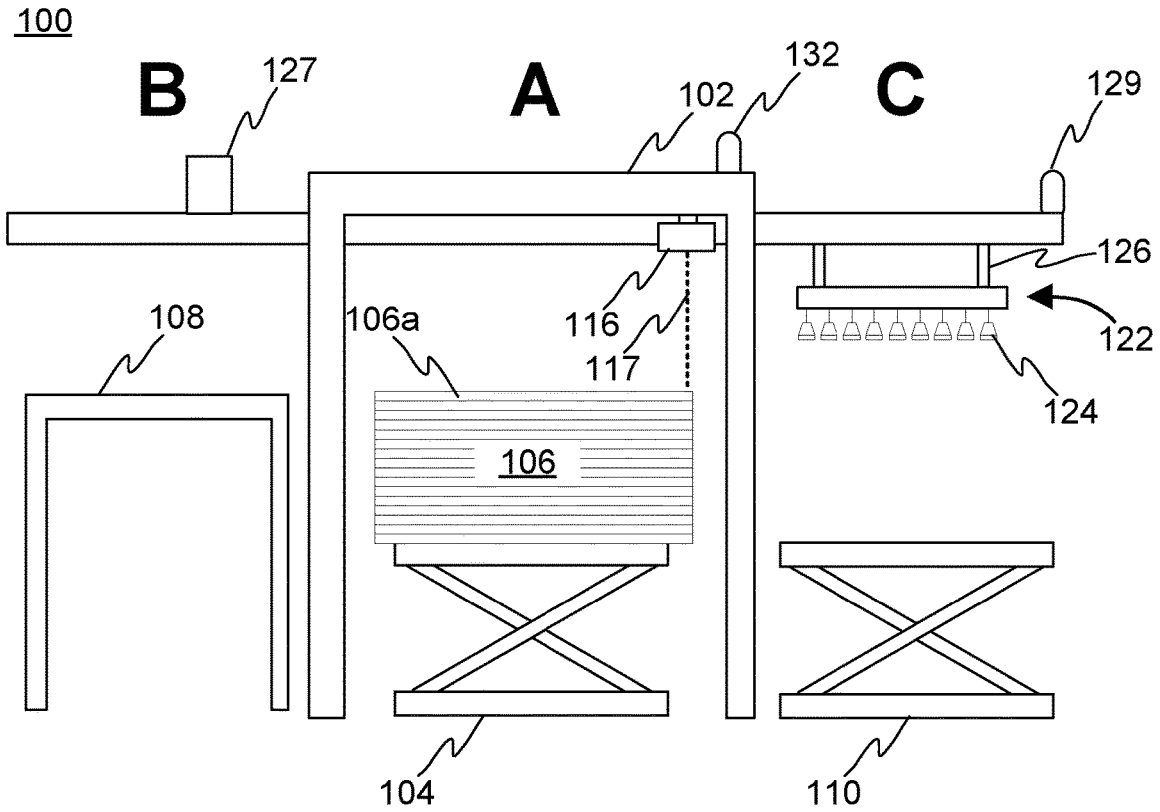
Figure 1C:
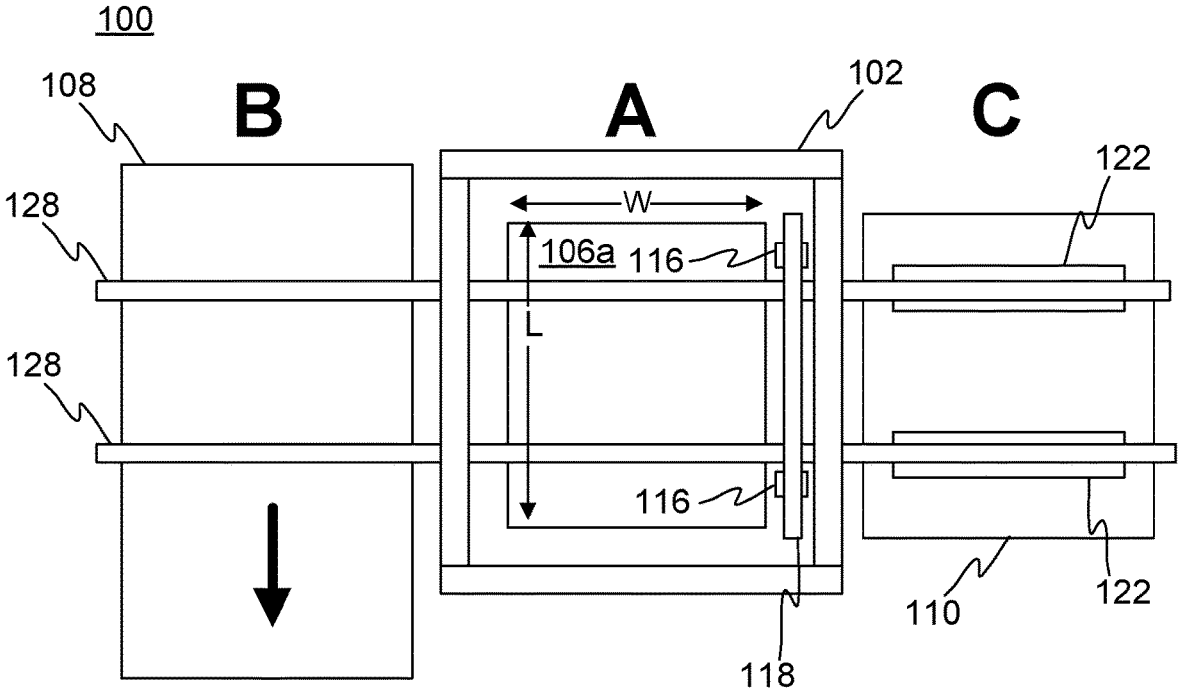
Figure 1D:
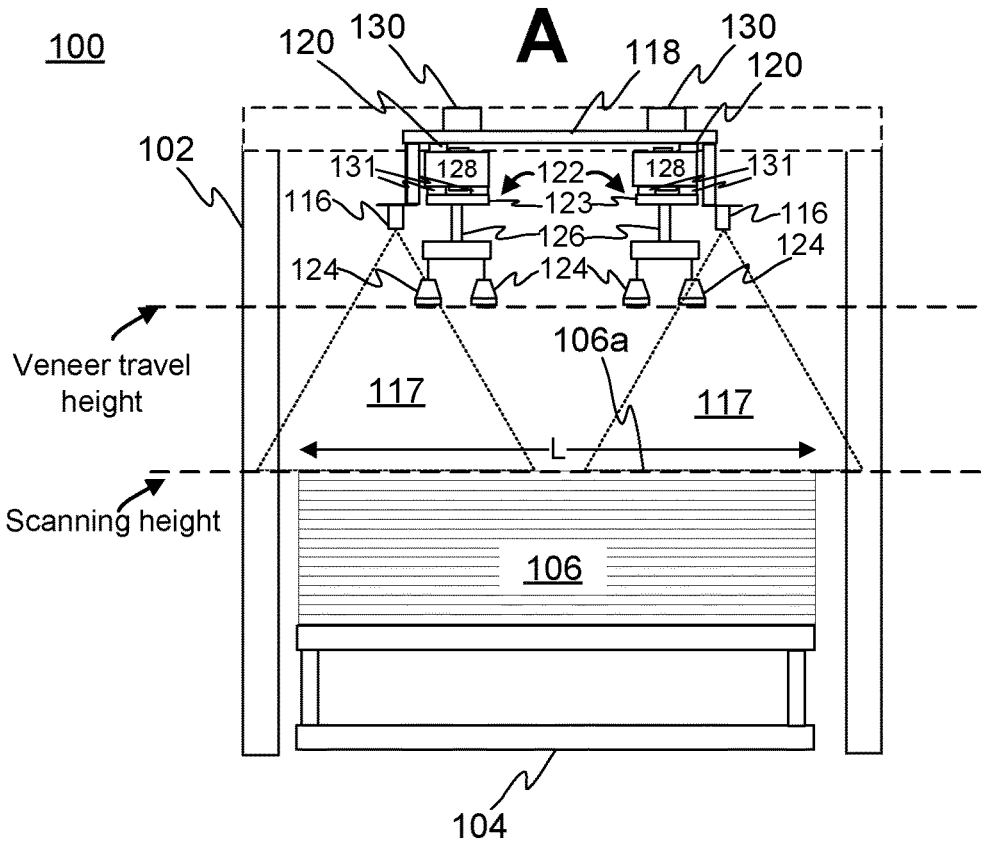

FIG. 1A illustrates schematically an example of a system 100 for sorting veneer sheets according to the invention. The system 100 comprises at least the following sections: a feeding section (referred with symbol A in FIG. 1A), an assembly section (referred with symbol B in FIG. 1A), and a reject section (referred with symbol C in FIG. 1A). In a sorting operation provided by the system 100 the veneer sheets may be transferred from the feeding section A to the assembly section B or to the reject section C according to condition of the veneer sheets in order to sort the veneer sheets to acceptable veneer sheets and reject veneer sheets as will be described. In other words, the acceptable veneer sheets, i.e. undamaged and whole veneer sheets, may be transferred from the feeding section A to the assembly section B for handing the acceptable veneer sheets and the reject veneer sheets, i.e. unacceptable veneer sheets, may be transferred from the feeding section A to the reject section C for handling the reject veneer sheets. The feeding section A may be arranged between the assembly section B and the reject section C as illustrated in the example of FIG. 1A, wherein on one side of the feeding section A is the assembly section B and on the opposite side is the reject section C. In other words, the assembly section B, the feeding section A, and the reject section C may be arranged next to each other so that the feeding section A is between the assembly section B and the reject section C. In the example of FIG. 1A assembly section B resides on the left side of the feeding section A and the reject section C resides on the right side of the feeding section A. However, the present invention may also be implemented so that the reject section C resides on the left side of the feeding section A and the assembly section B resides on the right side of the feeding section A. The system 100 according to an embodiment of the invention may comprise a frame structure 102 into which at least part of the devices belonging to system 100 as will be described may be mounted either in a fixed manner or movably. FIG. 1B illustrates a side view of the example system 100 illustrated in FIG. 1A. FIG. 1C illustrates a top view of the example system 100 illustrated in FIGS. 1A and 1B. FIG. 1D illustrates an end view of the example system 100 illustrated in FIGS. 1A to 1C viewed from the assembly section B side or from the reject section C side.

The feeding section A comprises a feeding hoisting device 104 configured to receive a stack of veneer sheets 106 to be sorted and to adjust the height of the stack of veneer sheets 106 in a vertical direction so that a top surface of a topmost veneer sheet 16*a* of the stack of veneer sheets 106 is at a scanning height. In other words, the height may be adjusted so that a scanning operation as will be described may be performed at a predetermined height. Moreover, the adjustment of height may be controlled so that the height is adjusted continuously in response to a change of height of the stack 106. In other words, the top surface of the prevailing topmost veneer sheet 106*a* of the stack of veneer sheets 106 may be maintained approximately at the same level, i.e. at the scanning height. In order to achieve this, the system 100 may comprise one or more sensor devices, e.g. photocells, (not shown in FIGS. 1A-1D) configured to obtain data to determine that the top surface of the topmost veneer sheet 106*a* of the stack of veneer sheets 106 is at the scanning height. The one or more sensor devices may be arranged for example to the frame structure 102. The stack of veneer sheets 106 refers throughout this application to a pile comprising a plurality of the veneer sheets.

The assembly section B may comprise for example a conveyor device 108, e.g. an assembly line, configured to receive the acceptable veneer sheets transferred from the feeding section A for further handling the acceptable veneer sheets. The reject section C may comprise a reject hoisting device 110 configured to receive the rejected veneer sheets transferred from the feeding section A for further handling the rejected veneer sheets. Rejected veneer sheets may comprise e.g. veneer sheets comprising one or more defects, partial veneer sheets, and/or broken veneer sheets.

The system 100 according to the invention may be implemented as a part, i.e. a sub-system, of a manufacturing system of wood products comprising one or more other sub-systems for performing one or more other operations of the manufacturing process of wood products. Alternatively or in addition, the system 100 according to the invention may comprise one or more further sections or entities for performing one or more other operations of manufacturing process of wood products. For example, the example system 100 of FIG. 1A may comprise further entities, such as one or more conveyor devices 112, by means of which the veneer sheets may be conveyed to the system 100 (for sake of clarity the one or more conveyor devices are not show in FIGS. 1B to 1D). In other words, the feeding hoisting device 104 of the feeding section A may receive the stack of veneer sheets 106 from the one or more conveyor devices 112. The veneer sheets may be transported to the system 100 in the stack of veneer sheets 106 as illustrated in the non-limiting example according to FIGS. 1A to 1C. Alternatively or in addition, the reject veneer sheets and/or the acceptable veneers sheets may be transported from the system 100 in a stack of veneer sheets.

The system 100 according to the invention further comprises a control system 114 configured to control the operation of the devices belonging to the system 100 as will be described. The control system 114 may comprise one or more control units configured to separately or in collaboration with each other control the operation of one or more of the entities of the system 100. The controlling may comprise generating by the one or more control units one or more control signals for one or more entities of the system 100. The control system 114, i.e. the one or more control units of the control system, may be communicatively, and operatively, coupled to the other entities belonging to the system 100. The communication between the entities and the control system 114 may be implemented either in a wired manner or wirelessly by applying known communication technologies, for example. The control system 114 may comprise at least one processor, at least one memory being volatile or non-volatile for storing portions of computer program code and any information, e.g. scan lines, surface scan image, etc., a communication interface, and possibly one or more user interface units. The mentioned elements may be communicatively coupled to each other with e.g. an internal bus. For sake of clarity, the processor herein refers to any unit suitable for processing information and control the operation of the control system, among other tasks. Similarly, the memory is not limited to a certain type of memory only, but any memory type suitable for storing pieces of information may be applied in the context of the present invention. The at least one processor of the control system 114 may be at least configured to implement at least some operations of the control system 114 as will be described. The implementation of the operations of the control system 114 may be achieved by arranging the at least one processor to execute at least some portion of computer program code stored in the at least one memory causing the processor, and thus the control system 114, to implement one or more operations of the control system 114 as will be described.

The system 100 according to the invention further comprises at least one detection device 116 configured to scan the top surface of the topmost veneer sheet 106*a* of the stack of veneer sheets 106 to provide a plurality of successive scan lines of the top surface of the topmost veneer sheet 16*a* while the at least one detection device 116 is moving, i.e. travelling, over the stack of veneer sheets 106 in a horizontal direction between the assembly section B side of the feeding section A and the reject section C side of the feeding section A. The at least one detection device 116 may be arranged to move over the stack of veneer sheets 106 in the width direction of the topmost veneer sheet 106*a* as illustrated in the example of FIG. 10. However, the invention is not limited to that and the at least one detection device 116 may be arranged to move over the stack of veneer sheets 106 in the length direction of the topmost veneer sheet 106*a*, i.e. the stack of veneer sheets 106 may be arranged on the feeding hoisting device 104 so that the at least one detection device 116 may travel over the stack of veneer sheets 106 in the length direction of the topmost veneer sheet 106*a*. The top surface of the topmost veneer sheet 106*a* of the stack of veneer sheets 106 is arranged at the scanning height by means of the feeding hoisting device 104 for the scanning operation performed by the at least one detection device 116. The scanning device 116 may be such that it is capable to find the edges of the topmost veneer sheet 106*a* and to determine if the topmost veneer sheet 106*a* is partial or broken or if the topmost veneer sheet comprises one or more defects. The at least one detection device 116 may be e.g. a laser line scanner device. The at least one detection device 116 may be configured to generate at least one light line, such as laser light line, 117 to the top surface of the topmost veneer sheet 106*a* for obtaining the plurality of successive scan lines of the top surface of the topmost veneer sheet 106*a*. The generated at least one light line, e.g. the laser light line, 117 may be substantially perpendicular, i.e. 5 degrees from the perpendicular direction, to the moving direction of the at least one detection device 116 in the horizontal direction and/or substantially perpendicular, i.e. ±10 degrees from the perpendicular direction, to the surface of the topmost veneer sheet 106 in the vertical direction as illustrated e.g. in FIGS. 1A and 1B.

Figure 1E:
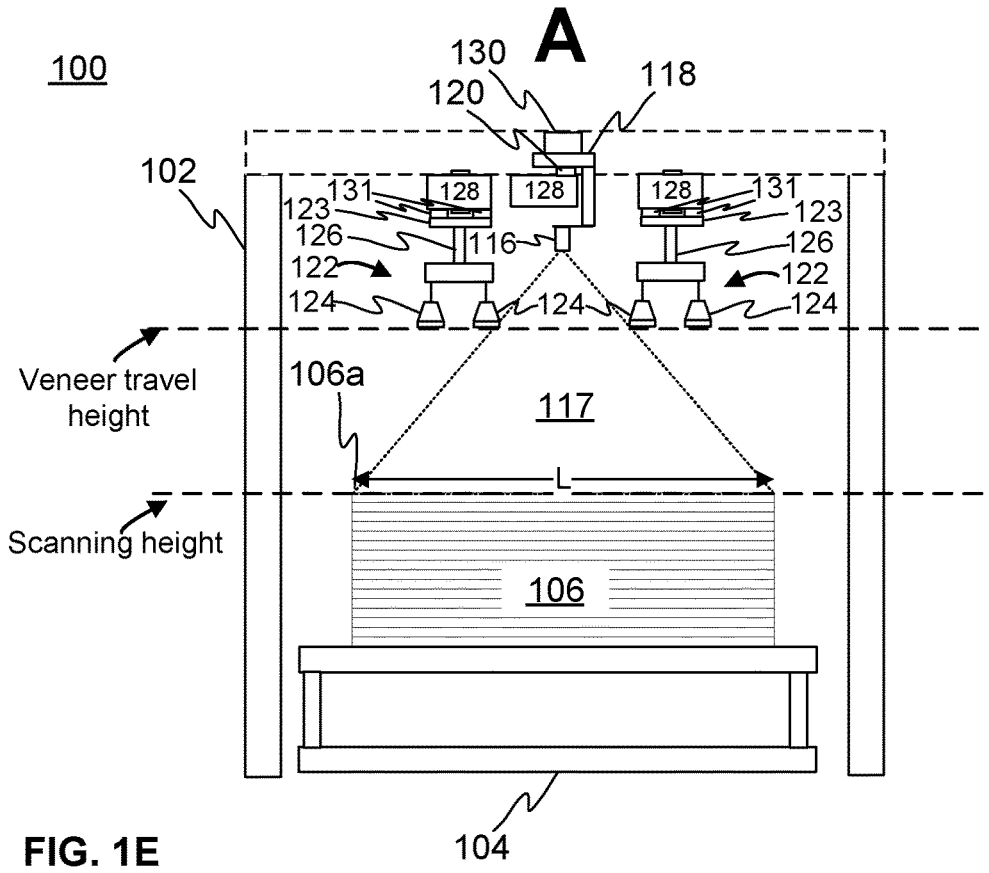
FIG. 1E illustrates schematically an end view of another example of the system according to the invention.

The at least one detection device 116 may be arranged movably in the frame structure 102 so that the at least one detection device 116 is configured to travel over the veneer sheet under scanning, i.e. the topmost veneer sheet 106*a* of the stack of veneer sheets 106, to provide the plurality of successive scan lines of the top surface of the topmost veneer sheet 16*a*. According to an example, the movable arrangement of the at least one detection device 116 may be implemented by mounting the at least one detection device 116 to a detection carriage device 118, which may be configured to travel along one or more rails, belts or chains 120 arranged to the frame structure 102, e.g. to one or more beams 128 of the frame structure 102. In other words, the at least one detection device 116 mounted to the detection carriage device 118 may be caused to travel along the one or more rails, belts, or chains 120 arranged to the frame structure 102, e.g. to one or more beams 128 of the frame structure 102. For example, in the example of FIG. 1D two detection devices 116 are mounted to the detection carriage device 118, which is arranged to travel along two rails 120. Each rail 120 is arranged to a top surface of one of the beams 128 so that each rail 120 runs parallel along the beam 128 in the longitudinal direction of the beam 128. For sake of clarity the rails 120 are not shown in FIGS. 1A-1C. Preferably, the detection carriage device 118 may be configured to travel along one or more rails 120 to enable rigid mounting of the at least one detection device 116, which in turn may improve an accuracy of an image obtained with the at least one detection device 116. Because the belts and chains are more flexible than rails, the use of one or more belts or chains may cause that the at least one detection device 116 rotates, which in turn may decrease an accuracy of an image obtained with the at least one detection device 116. The system 100 may further comprise one or more synchronous belts 130 with pulleys configured to move the detection carriage device 118 and the at least one detection device 116 mounted to the detection carriage device 118 along the one or more rails 120. The system 100 further comprises a motion generation device. e.g. an electric motor, 132 for generating a force causing the movement of at least one detection device 116. In other words, the at least one detection device 116 may be controlled to move over the stack of veneer sheets 106 in the horizontal direction between the assembly section B side and the reject section C side of the feeding section A. One detection device 116 may be sufficient for scanning the top surface of the veneer sheet, if the dimensions, i.e. width and/or height, of the veneer sheet are substantially small, i.e. the laser line 117 of the one detection device 116 covers the top surface of the topmost veneer sheet 106*a* in the direction perpendicular to the moving direction of the at least one detection device 116 in the horizontal direction, e.g. in the length direction in the example of FIG. 1E. FIG. 1E illustrates an example, wherein the system 100 comprises one detection device 116. Preferably, the system 100 comprises two detection devices 116 as illustrated in the example of FIGS. 1A to 1D in order to be able to scan the top surface of the veneer sheets with larger dimensions. For transferring veneer sheets with even larger dimensions, more than two detection devices 116 may be used. When the system 100 comprises more than one detection device 116, the detection devices 116 may be arranged in parallel so that the laser lines 117 of the detection devices 116 cover the top surface of the topmost veneer sheet 106*a* in the direction perpendicular to the moving direction of the at least one detection device 116 in the horizontal direction, e.g. in the length direction in the example of FIGS. 1C and 1D.

In the example of FIGS. 1A-1E an initial situation of the sorting operation of the system 100 according to the invention is illustrated. In the initial situation of the system 100 the stack of veneer sheets 106 is received by the feeding hoisting device 104 and the height of the stack of veneer sheets 106 is adjusted in the vertical direction by the feeding hoisting device 104 so that the top surface of the topmost veneer sheet 106*a* of the stack 106 is at the scanning height. According to an example embodiment of the invention, in the initial situation the at least one detection device 116 may be arranged to locate at the reject section C side of the feeding section A causing that an initial moving direction of the at least one detection device 116, i.e. scanning direction of the topmost veneer sheet 106*a*, may be from the reject section C side of the feeding section A to the assembly section B side of the feeding section A. However, the invention is not limited to that and alternatively in the initial situation the at least one detection device 116 may be arranged to locate at the assembly section B side of the feeding section A causing that the initial moving direction of the at least one detection device 116, i.e. scanning direction of the topmost veneer sheet 106*a*, may be from the assembly section B side of the feeding section A to the reject section C side of the feeding section A.

The system 100 according to the invention further comprises at least two transfer devices 122 for transferring the topmost veneer sheet 106*a* from the stack of veneer sheets 106 to the assembly section B or to the reject section C according to the condition of the topmost veneer sheet 106*a* defined based on a surface scan image formed, i.e. created or constructed, from the plurality of successive scan lines as will be described. Each of the at least two transfer devices 122 may comprise a plurality of suction devices 124, e.g. cups or nozzles, configured to grip, i.e. grasp, to the top surface of the veneer sheet to be transferred by activating one or more of the plurality of suction devices 124 of each of the least two transfer devices 122. The plurality of suction devices 124 of each of the at least two transfer devices 122 may be arranged in two or more parallel rows. For example, in the examples of FIGS. 1A to 1E the system 100 comprises two transfer devices 122 each comprising a plurality of suction devices 124 arranged in two parallel rows. Each of the at least two transfer devices 122 may further comprise one or more actuator devices 126 configured to move the plurality of suction devices 124 in a vertical direction between a veneer travelling height and the scanning height so that the plurality of suction devices 124 are able to reach the topmost veneer sheet 106*a* to be transferred, which is arranged at the scanning height. The system 100 according to the invention further comprises at least two pumps 127, e.g. vacuum pumps or ejectors, for generating the suction, i.e. vacuum, for the plurality of suction devices 124 of the at least two transfer devices 122. The at least two pumps 127 may preferably be speed controlled to adjust the amount of suction of the plurality of the suction devices 124.

The activation and/or deactivation of each of the plurality of the suction devices 124 may be individually controllable by the control system 114. Alternatively, the activation and/or deactivation of the plurality of the suction devices 124 may be controlled by the control system 114 in one or more groups. Each group may comprise one or more suction devices 124. The activation and/or deactivation of the plurality of suction devices 124 individually or in groups of suction devices 124 allows a pick-up of partial veneer sheets and/or veneer sheets with defects without disturbing the subsequent veneer sheet in the stack 106 residing below the topmost veneer sheet 106*a* to be transferred.

The at least two transfer devices 122 may be movably arranged in the frame structure 102 so that the two transfer devices 116 are configured to transfer the topmost veneer sheet 106*a* from the stack of veneer sheets 106 to the assembly section B or to the reject section C. Moreover, the at least two transfer devices 122 are arranged in parallel so that the at least two transfer devices 122 are configured to move parallel with each other. According to an example, the movable arrangement of the at least two transfer devices 122 may be implemented by mounting each of the at least two transfer devices 122 to a transfer carriage device 123 which is configured to travel along one or more rails 131 arranged to the frame structure 102, e.g. to one or more beams 128 of the frame structure 102. In other words, the at least two transfer devices 122 mounted to the transfer carriage devices 123 may be caused to travel along the rails 131 arranged to the frame structure 102, e.g. to one or more beams 128 of the frame structure 102. For example, in the example of FIG. 1D two transfer devices 122 are each mounted to the transfer carriage device 123, which is arranged to travel along two rails 131. Each rail 131 is arranged to a lower surface of the beam 128 of the frame structure 102 so that each rail 131 runs parallel along the beam 128 in the longitudinal direction of the beam 128. The rails 131 of the transfer carriage devices 123 may be arranged to the same beams 128 as the rails 120 of the detection carriage device 118 as illustrated in the example of FIG. 1D. However, the invention is not limited to that and the rails 131 of the transfer carriage devices 123 and the rails 120 of the detection carriage device 118 may be arranged to separate beams 128 as illustrated in the example of FIG. 1E. For sake of clarity the rails 131 are not shown in FIGS. 1A-1C. The one or more beams 128 and rails 131 arranged to the beams 128 may extend from the assembly section B over the feeding section A to the reject section C. This enables that the at least two transfer devices 122 are capable to transfer the veneer sheets from the feeding section A to the assembly section B and to the reject section C. For example, in the example system 100 of FIGS. 1A to 1E each of the two transfer devices 122 are travelling along one rail 131. The system 100 may further comprises two or more synchronous belts 134 with pulleys configured to move the transfer carriage devices 123 and the at least two transfer devices 122 mounted to the transfer carriage devices 123 along the one or more rails 131. Each of the synchronous belts 134 are arranged around the outer surface of one beam 128 in the longitudinal direction of the beam 128 as illustrated in the example of FIG. 1A. For sake of clarity the synchronous belts 134 are not shown in FIGS. 1B and 1C. The system 100 according to the invention further comprises at least two motion generation devices, such as electric motors, e.g. servo motors, 129 for generating a force causing the movement of the at least two transfer devices 122. In other words, the system 100 may comprise individual motion generating device 129 for each of the at least two transfer devices 122. Each of the at least two motion generation devices 129 may be independently controllable to enable independent control of each of the at least two transfer devices 122. The at least two transfer devices 122 are movably arranged in the frame structure 102 so that the at least two transfer devices 122 are configured to move parallel to the at least one detection device 116.

In the initial situation of the sorting operation illustrated in the examples of FIGS. 1A-1C, the at least two transfer devices 122 are positioned at an avoidance position. The avoidance position may be a position, where the at least two transfer devices 122 are away from, i.e. a clear of, a scanning path of the at least one detection device 116. In other words, the avoidance position may be any position, where the at least two transfer devices 122 are not located at the scanning path of the at least one detection device 116 at the same point simultaneously with the at least one detection device 116. This provides a greater view of the top surface of the topmost veneer sheet 106*a* to be scanned for the at least one detection device 116, which enables obtaining wider scan coverage of the top surface of the topmost veneer sheet 106*a* to be scanned. In the example of FIGS. 1A-1C the at least two transfer devices 122 are arranged to the avoidance position locating at the reject section C, i.e. over the reject hoisting device 110. However, this is only one example of the avoidance position of the at least two transfer devices 122 and the invention is not limited to that and any other avoidance position may be used, as long as the at least two transfer devices 122 are clear of the scanning path of the at least one detection device 116.

Figure 2A:
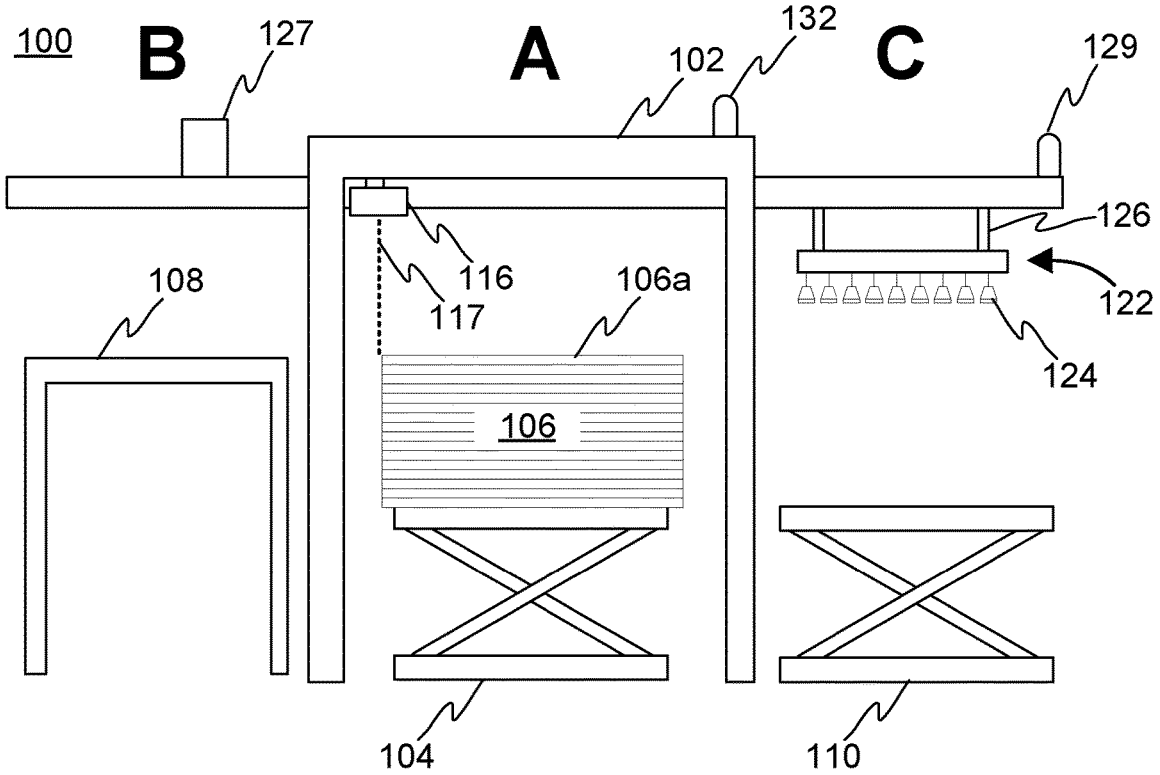
FIGS. 2A-2B illustrate schematically different views of another example of the system according to the invention.
Figure 2B:
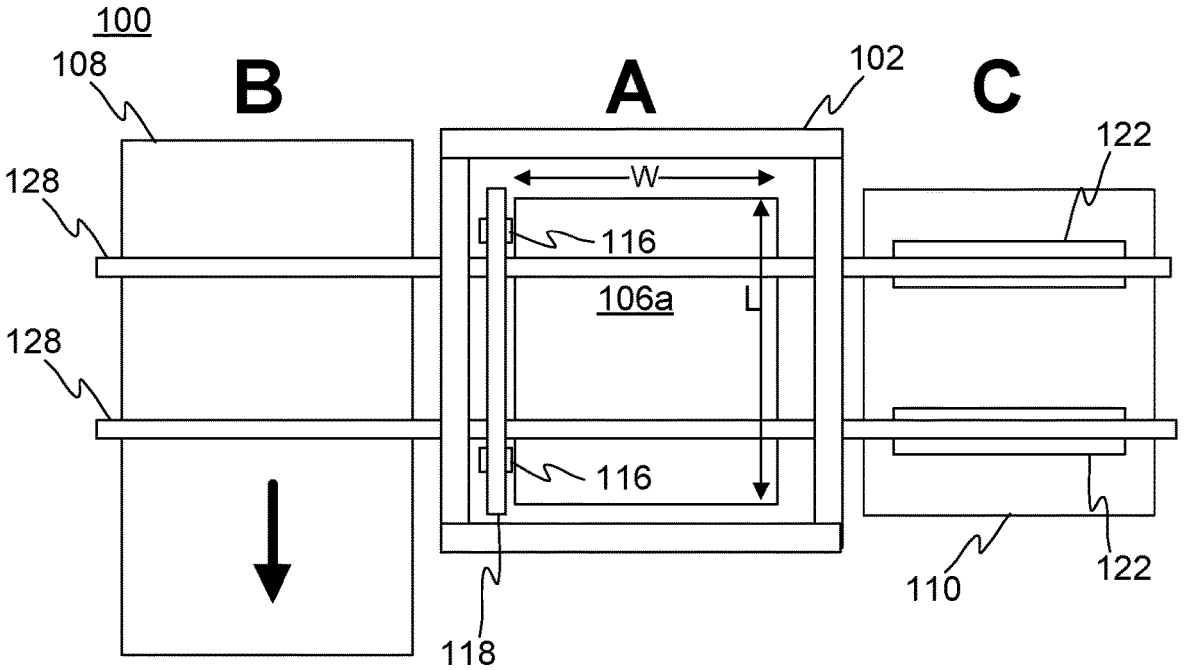

The control system 114 is configured to control the at least one detection device 116 to scan the top surface of the topmost veneer sheet 106*a* of the stack of veneer sheets 106 to provide the plurality of successive scan lines of the top surface of the topmost veneer sheet 106*a* while moving over the stack of veneer sheets 106 from the reject section C side of the feeding section A to the assembly section side B of the feeding section. The scanning operation provided by the at least one detection device 116 may be controlled so that the scanning starts outside an edge of the topmost veneer sheet 106*a* and ends outside the opposite edge of the topmost veneer sheet 106*a*. This enables that the top surface of the topmost veneer sheet 106*a* may be scanned entirely in the direction perpendicular to the moving direction of the at least one detection device 118 in the horizontal direction, FIG. 2A illustrates a side view of the example system 110 according to the invention, wherein the at least one detection device 116 has been moved from the reject section side C of the feeding section A to the assembly section B side of the feeding section A during the scanning operation. FIG. 2B illustrates a top view of the example system 110 illustrated in FIG. 2A. The scanning operation provided by the at least one detection device 116 may be controlled so that the scanning starts outside an edge of the topmost veneer sheet 106*a* and ends outside the opposite edge of the topmost veneer sheet 106*a*. This enables that the top surface of the topmost veneer sheet 106*a* may be scanned entirely the direction perpendicular to the moving direction of the at least one detection device 116 in the horizontal direction, e.g. in the length direction in the example of FIG. 2B.

The at least one detection device 116 is configured to communicate the plurality of successive scan lines to the control system 114. The control system 114 is further configured to provide a surface scan image from the plurality of successive scan lines provided by the at least one detection device 116. The surface scan image represents a scan result of the scanned top surface of the topmost veneer sheet 106*a*. The control system 114 is further configured to determine one or more properties of the topmost veneer sheet 106*a* based on the surface scan image. The one or more properties of the topmost veneer sheet 106*a* may comprise: length; width; and/or number, size, and/or form of defects in the veneer sheet.

In response to determining the one or more properties of the topmost veneer sheet 106*a*, the control system 114 may be configured to compare each of the determined one or more properties of the topmost veneer sheet 106*a* to a respective predetermined criterion. In other words, for each property of the veneer sheet may be predetermined a criterion to which the respective property of the topmost veneer sheet 106*a* determined from the surface scan image may be compared. If the control system 114 detects that each of the determined one or more properties of the topmost veneer sheet 106*a* meets the respective predetermined criterion, the control system 114 may define that the topmost veneer sheet 106*a* is acceptable and may be moved to the assembly section B. Alternatively, if the control system 114 detects that at least one of the determined one or more properties of the topmost veneer sheet 106*a* does not meet the respective predetermined criterion, the control system 114 may define that the topmost veneer sheet is unacceptable, i.e. reject veneer sheet, and may be moved to the reject section C. The predetermined criteria of the one or more properties may comprise e.g. a specific width of the veneer sheet representing acceptable width of the veneer sheets, a range of acceptable widths of the veneer sheet, a specific length of the veneer sheet representing acceptable length of the veneer sheets, a range of acceptable lengths of veneer sheet, and/or a specific number of defects in the veneer sheet, wherein the specific number of defects is preferably zero. In other words, if the control system 114 detects that the determined width of the topmost veneer sheet 106*a* meets the predetermined criterion for the width of the veneer sheet, e.g. the determined width of the topmost veneer sheet 106*a* is within a predetermined range of acceptable widths of the veneer sheet, the determined length of the topmost veneer sheet 106*a* meets the predetermined criterion for the length of the veneer sheet, e.g. the determined length of the topmost veneer sheet 106*a* is within a predetermined range of acceptable lengths of the veneer sheet, and that the topmost veneer sheet 106*a* does not comprise any defects, the control system 114 may define that the topmost veneer sheet 106*a* is acceptable and may be transferred to the assembly section B. However, if the control system 114 detects that the determined width of the topmost veneer sheet 106*a* does not meet the predetermined criterion for the width of the veneer sheet, e.g. the determined width of the topmost veneer sheet 106*a* is less than a predetermined range of acceptable widths of the veneer sheet, the determined length of the topmost veneer sheet 106*a* does not meet the predetermined criterion for the length of the veneer sheet, e.g. the determined length of the topmost veneer sheet 106*a* is less than a predetermined range of acceptable lengths of the veneer sheet, and/or that the topmost veneer sheet 106*a* comprises one or more defects, the control system 114 may define that the topmost veneer sheet 106*a* is unacceptable, i.e. reject veneer sheet, and may be transferred to the reject section C.

Figure 3A:
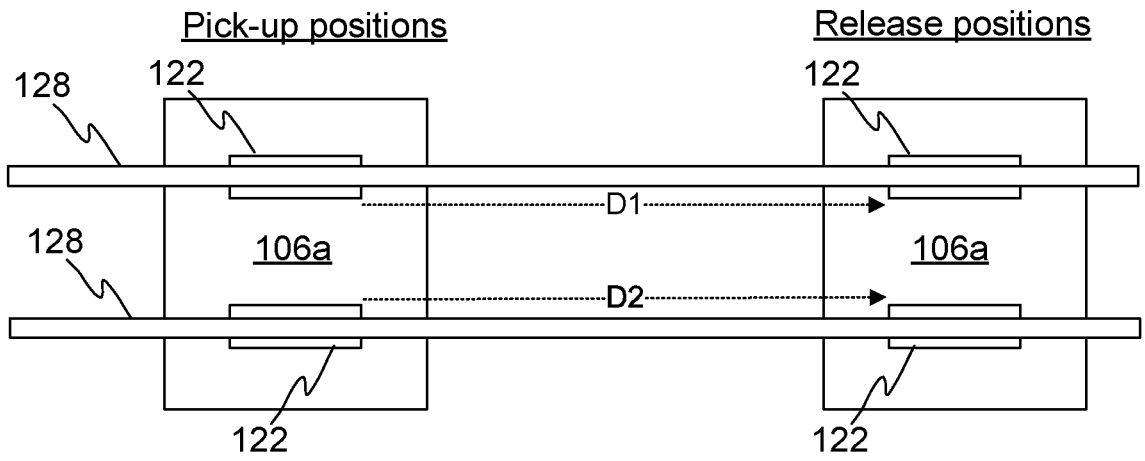
FIGS. 3A-3C illustrate schematically examples of pick-up positions, release positions, and transfer distances of transfer devices according to the invention.
Figure 3B:
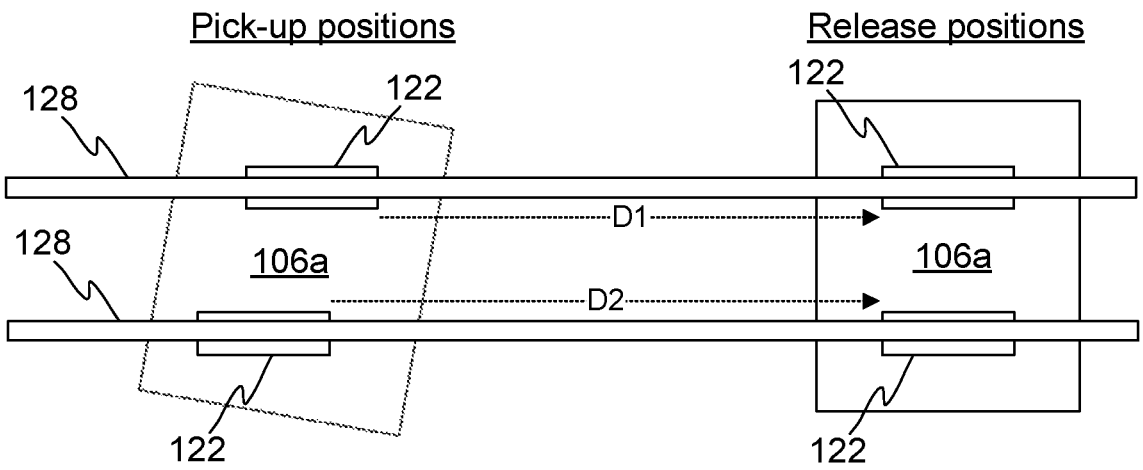
Figure 3C:
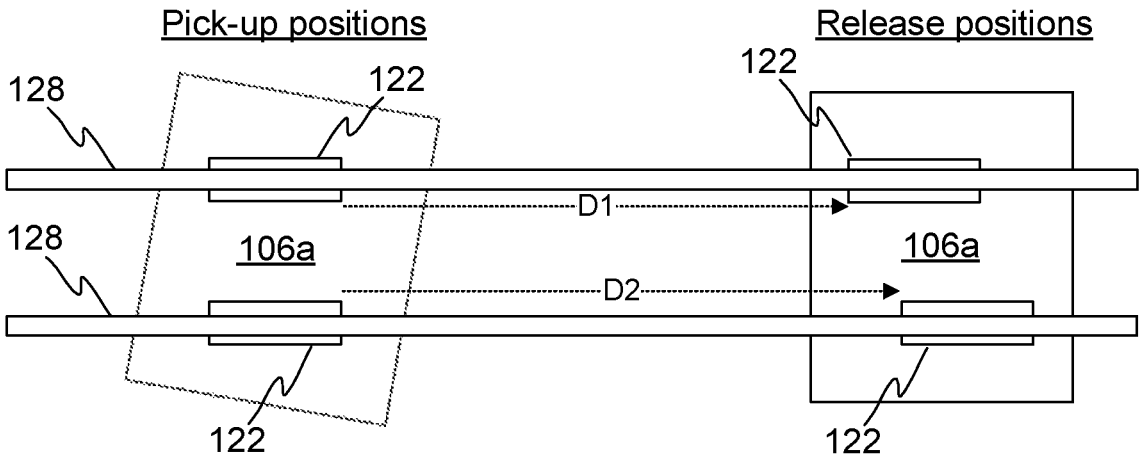

Moreover, the control system 114 may be configured to determine the orientation of the topmost veneer sheet 106*a* based on the surface scan image to define a pick-up position of the veneer sheet, a release position of the veneer sheet, and/or transfer distance between the pick-up position and the release position for the at least two transfer devices 122. An individual pick-up position, an individual release position, and/or an individual transfer distance between the pick-up position and the release position may be determined for each of the at least two transfer devices 122 on the basis of the surface scan image so that the veneer sheet to be picked-up may be aligned to a desired orientation. For example, if the control system 114 detects based on the orientation of the topmost veneer sheet 106*a* in the surface scan image that the topmost veneer sheet 106*a* is misaligned with, i.e. at an angle to, the assembly line 108 or to the reject hoisting device 110, the control system 114 may define individual pick-up positions and/or an individual release position for each of the at least two transfer devices 122 so that the at least two transfer devices 122 may be positioned in a misalignment in longitudinal direction of the at least one beam 128 being similar as the topmost veneer sheet 106*a* to properly pick-up the topmost veneer sheet 106*a*, i.e. so that the picked-up veneer sheet 106*a* may be aligned with the assembly line 105 or the reject hoisting device 110. As a result of definition of the individual pick-up positions and/or the individual release positions for each of the at least two transfer devices 122, the transfer distances of at least two transfer devices 122 between the pick-up positions and the release positions may be unequal, i.e. individual. FIGS. 3A-3C illustrate some non-limiting examples of the pick-up positions, the release positions, and transfer distances determined for two transfer devices 122. In the examples of FIGS. 3A-3B the veneer sheet 106*a* is transferred to one direction, i.e. from left to right in these examples, but the veneer sheet 106*a* may also be transferred to the opposite direction as well. In the example of FIG. 3A the topmost veneer sheet 106*a* is detected to be correctly aligned with the assembly line 108 or the reject hoisting device 110. In this example, the pick-up positions and the release positions for the two transfer devices 122 are aligned with each other in the longitudinal direction of the beams 128 causing that the transfer distances D1 and D2 of the transfer devices 122 between the pick-up positions and the release positions are equally long. In the example of FIG. 3B the topmost veneer sheet 106*a* is detected to be misaligned with the assembly line 108 or the reject hoisting device 110. In this example, the pick-up positions defined for the two transfer devices 122 are misaligned in the longitudinal direction of the beams 128 and the release positions defined for the transfer devices 122 are aligned with each other in the longitudinal direction of the beams 128 causing that the transfer distances D1, D2 of the transfer devices 122 between the pick-up positions and the release positions are unequal. In the example of FIG. 3C the topmost veneer sheet 106*a* is detected to be misaligned with the assembly line 108 or the reject hoisting device 110. In this example, the pick-up positions defined for the two transfer devices 122 are aligned with each other in the longitudinal direction of the beams 128 and the release positions defined for the transfer devices 122 are misaligned in the longitudinal direction of the beams 128 causing that the transfer distances D1, D2 of the transfer devices 122 between the pick-up positions and the release positions are unequal.

Figure 4A:
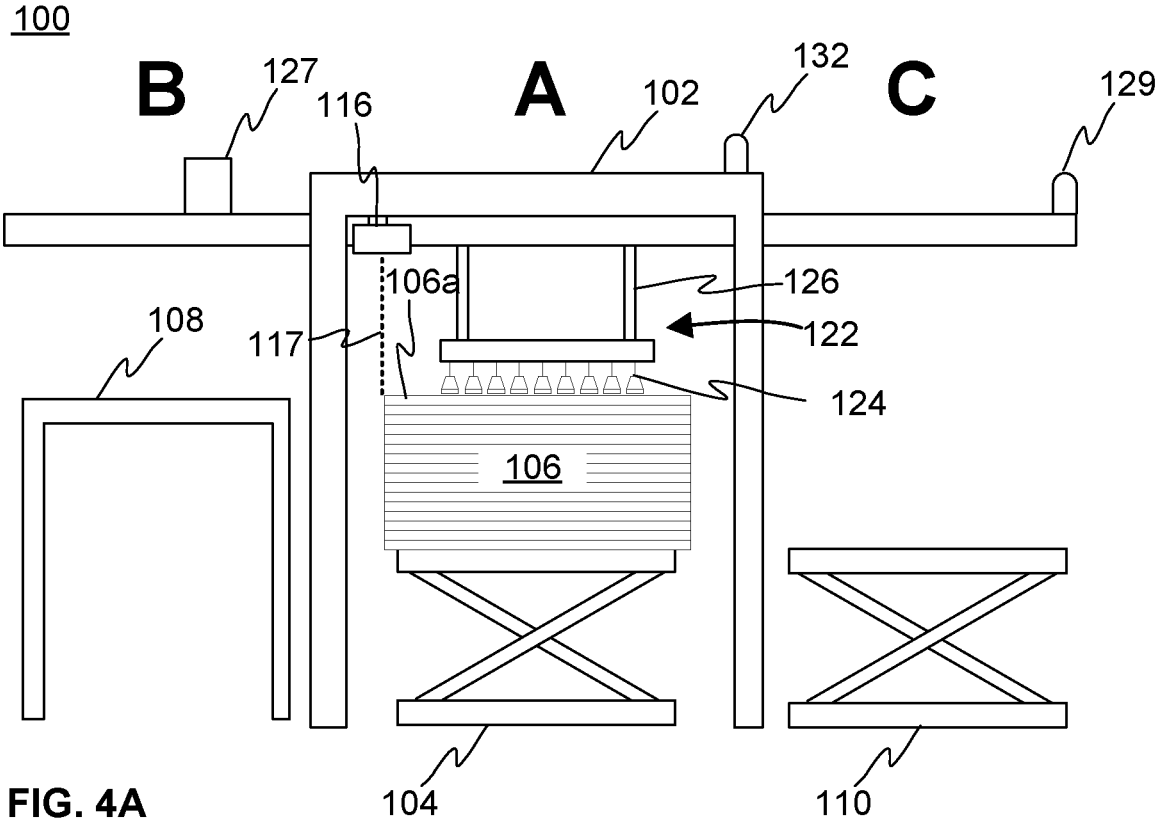
FIGS. 4A-4C illustrate schematically another example of the system according to the invention.

In response to defining based on the surface scan image whether the topmost veneer sheet 106*a* is acceptable veneer sheet or reject veneer sheet as discussed above, the control system 114 is configured to control the at least two transfer devices 122 to move from the avoidance position to the pick-up position determined based on the surface scan image and to pick-up the topmost veneer sheet 106*a* of the stack of veneer sheets 106. To pick-up the topmost veneer sheet 106*a* the control system 114 may be configured to control the one or more actuator devices 126 of the at least two transfer devices 122 to lower the plurality of suction devices 124 in the vertical direction so that the plurality of the suction devices 124 of the at least two transfer devices 122 reach the top surface of the topmost veneer sheet 106*a*. The control system 114 may further be configured to control the activation of one or more of the suction devices 124 of the at least two transfer devices 122 so that the one or more suction devices 124 grip to the top surface of the topmost veneer sheet 106*a*. The one or more suction devices 124 of each of the at least two transfer devices 122 required for the transferring operation may be defined based on the surface scan image and the activation of the one or more suction devices 124 may be controlled individually or in groups of suction devices 124 as described above. FIG. 4A illustrates a side view of the example system 110 according to the invention, wherein the plurality of the suction devices 124 of the at least two transfer devices 122 are gripping to the top surface of the topmost veneer sheet 106*a*.

After the plurality of suction device 124 have gripped to the top surface of the topmost veneer sheet 106*a*, the control system 114 may be configured to control the one or more actuator devices 126 of the at least two transfer devices 122 to lift the plurality of suction devices 124 and the picked-up veneer sheet to which the plurality of suction devices 124 are gripped in the vertical direction at the veneer travel height so that the at least two transfer devices 122 are capable to transfer the picked-up veneer sheet in the horizontal direction.

The system 100 may further comprise one or more sensor devices, e.g. photocells, (not shown in FIG. 4A) configured to determine whether the pick-up of the veneer sheet is successful or not. The one or more sensor devices may be arranged for example to the frame structure 102 or to a transfer carriage device 123. The one or more sensor devices may be the same one or more sensor devices for determining that the top surface of the topmost veneer sheet 106*a* of the stack of veneer sheets 106 is at the scanning height. Alternatively, the system 100 may comprise separate one or more scanning devices for determining successful pick-up of the veneer sheet and for determining that the top surface of the topmost veneer sheet 106*a* of the stack of veneer sheets 106 is at the scanning height. Preferably, separate one or more sensor devices may be used to determine whether the pick-up of the veneer sheet is successful or not and to determine that the top surface of the topmost veneer sheet 106*a* of the stack of veneer sheets 106 is at the scanning height in order to improve the reliability of the system. If the one or more sensor device detects that the pickup was not successful, the control system 114 may be configured to control the at least two transfer devices to repeat the pick-up operation of the topmost veneer sheet 106*a* again, e.g. with a higher pick-up suction.

Figure 4B:
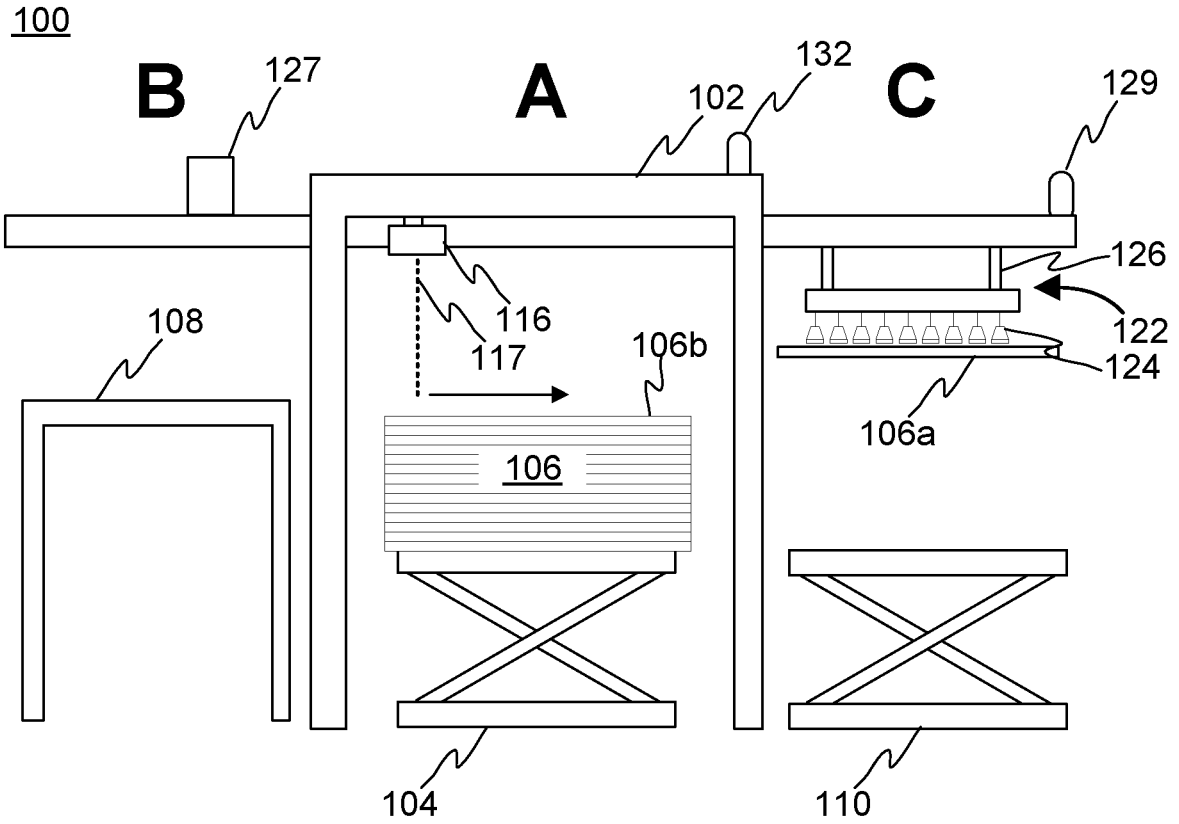
Figure 4C:
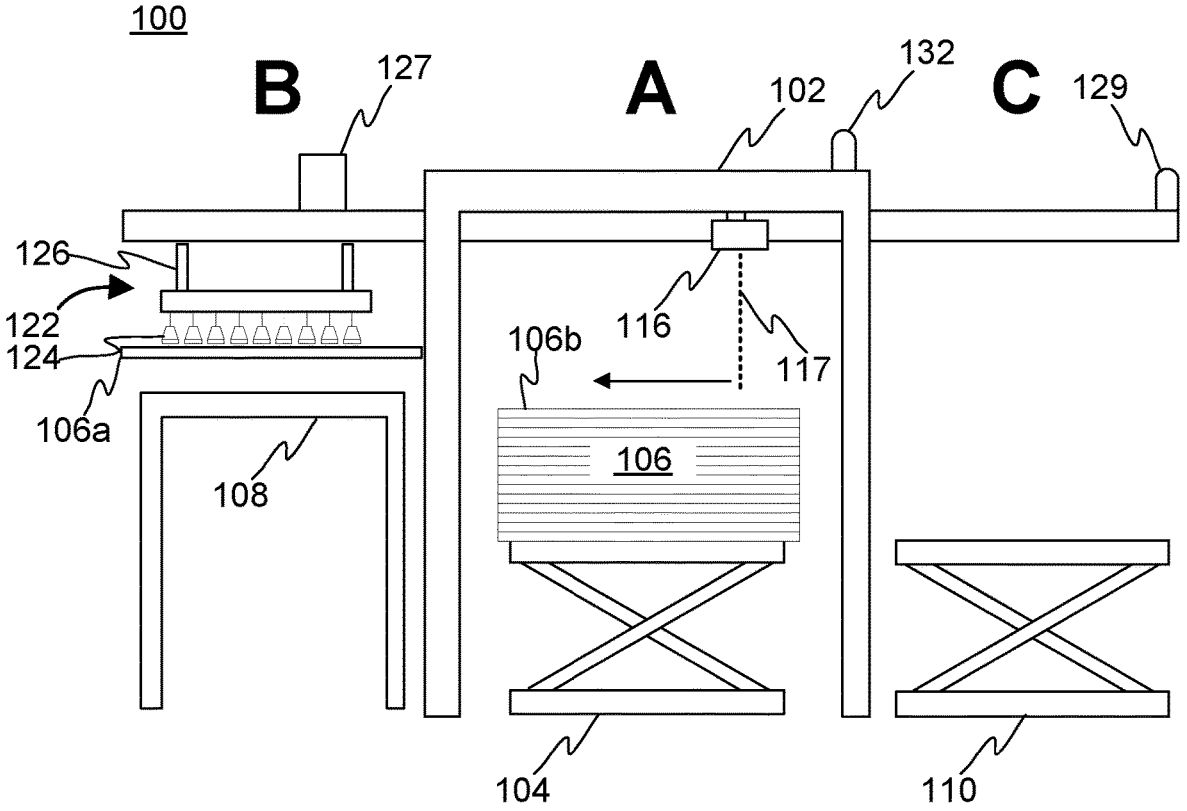

Once a successful pick-up is detected with the one or more sensor devices, the control system 114 is further configured to control the at least two transfer devices 122 to transfer the picked-up veneer sheet to the assembly section B or to the reject section C according to the condition of the topmost veneer sheet 106*a* defined based on the surface scan image. In other words, the control system 114 is configured to control the at least two transfer devices 122 to transfer the picked-up veneer sheet to the assembly section B in response to detecting that each of the determined one or more properties of the veneer sheet meets the respective predetermined criterion, or otherwise, i.e. if at least one of the determined one or more properties of the veneer sheet does not meet the respective predetermined criterion, to transfer the picked-up veneer sheet to the reject section C as described above. FIG. 4B illustrates a side view of the example system 110 according to the invention, wherein the picked-up veneer sheet 106*a* defined as a reject veneer sheet and transferred from the feeding section A to the reject section C. FIG. 4C illustrates a side view of the example system 110 according to the invention, wherein the picked-up veneer sheet 106*a* defined as an acceptable veneer sheet and transferred from the feeding section A to the assembly section B.

When the at least two transfer devices 122 are arranged at the release positions a drop operation, i.e. a release operation, may commence. To drop the picked-up veneer sheet the control system 114 may be configured to control the one or more actuator devices 126 of the at least two transfer devices 122 to lower the plurality of suction devices 124 in the vertical direction so that the picked-up veneer sheet reaches or is close to, i.e. a short distance above, a top surface of the conveyor device 108 of the assembly section B or the reject hoisting device 110 of the reject section C depending on the destination of the picked-up veneer sheet for releasing the picked-up veneer sheet. The short distance may be e.g. less than 100 millimetres (i.e. 4 inch), preferably less than 25 millimetres (i.e. 1 inch). The short distance between the picked-up veneer sheet and the top surface of the conveyor device 108 of the assembly section B enables that the conveyor device 108 does not need to be stopped when the picked-up veneer sheet is released. The control system 114 is further configured to control the deactivation of one or more of the suction devices 124 of the at least two transfer devices 122 so that the one or more suction devices 124 may be deactivated to release the veneer sheet from the one or more suction devices 124. The deactivation of the one or more suction devices 124 may be controlled in a sequence to prevent changes in the orientation of the veneer sheet while releasing from the one or more suction devices 124. Alternatively, some of the one or more suction devices 124 may be first controlled to deactivate in a specific sequence to release tension on the veneer sheet and to prevent changes in the orientation of the veneer sheet while releasing from the one or more suction devices 124. Once the tension is released, the remaining suction devices 124 may be controlled to deactivate. After the veneer sheet is released from the one or more suction devices 124 of the at least two transfer devices 122 the control system 114 may be configured to control the one or more actuator devices 126 of the at least two transfer devices 122 to lift the plurality of suction devices 124 in the vertical direction.

The at least one detection device 116 may be configured to scan a subsequent topmost veneer sheet 106*b* of the stack of veneer sheets 106 while the at least two transfer devices are still transferring the previous topmost veneer sheet 106*a* to the reject section C or to the assembly section B as described. The control unit 114 may be configured to clear the previous scanning results before, starting to scan the subsequent topmost veneer sheet 106*b*. The moving direction, i.e. the scanning direction, of the subsequent topmost veneer sheet 106*b* by the at least one detection device 116 may depend on the direction to which the at least two transfer devices 122 are configured to move to transfer the previous topmost veneer sheet 106*a* so that the scanning direction of the subsequent topmost veneer sheet 106*b* is the same direction as where the at least two transfer devices 122 are controlled to move to transfer the previous topmost veneer sheet 106*a*. In other words, the scanning direction of the subsequent topmost veneer sheet 106*b* by the at least one detection device 116 depends on the scanning result of the previous topmost veneer sheet 106*a*, i.e. whether the previous topmost veneer sheet 106*a* is defined to be acceptable or reject. If the previous topmost veneer sheet 106*a* is defined to be acceptable, the scanning direction of the subsequent topmost veneer sheet 106*b* is from the reject section C side of the feeding section A to the assembly section B side of the feeding section A. Alternatively, if the previous topmost veneer sheet 106*a* is defined to be unacceptable, i.e. reject, the scanning direction of the subsequent topmost veneer sheet 106*b* is from the assembly section B side of the feeding section A to the reject section C side of the feeding section A. The above defined scanning directions of the subsequent topmost veneer sheet 106*b* minimizes delays of transferring operations and scanning operations. For example, in the example of FIG. 4B, wherein the previous topmost veneer sheet 106*a* is defined to be unacceptable, i.e. reject, and the at least two transfer devices 122 are configured to travel to the reject section C to transfer the previous topmost veneer sheet 106*a* to the reject section C, the scanning direction of the subsequent topmost veneer sheet 106*b* (illustrated with the arrow in FIG. 4B) is from the assembly section B side of the feeding section A to the reject section C side of the feeding section A. If the at least one detection device 116 resides at the reject section C side of the feeding section A after the scanning operation of the previous topmost veneer sheet 106*a*, the at least one detection device 116 may be controlled to move to the assembly section B side of the feeding section A for the scanning operation of subsequent veneer sheet 106*b* while the at least two transfer devices 122 are performing the transferring operation the previous topmost veneer sheet 106*a*. For example, in the example of FIG. 4C, wherein the previous topmost veneer sheet 106*a* is defined as acceptable and the at least two transfer devices 122 are configured to travel to the assembly section A to transfer the previous topmost veneer sheet 106*a* to the assembly section B, the scanning direction of the subsequent topmost veneer sheet 106*b* (illustrated with the arrow in FIG. 4C) is from the reject section C side of the feeding section A to the assembly section B side of the feeding section A. If the at least one detection device 116 resides at the assembly section B side of the feeding section A after the scanning operation of the previous topmost veneer sheet 106*a*, the at least one detection device 116 may be controlled to move to the reject section C side of the feeding section A for the scanning operation of subsequent veneer sheet 106*b* while the at least two transfer devices 122 are performing the transferring operation the previous topmost veneer sheet 106*a*. The above described sorting operation continues for each veneer sheet of the stack of veneer sheets 106 one by one.

Figure 5A:
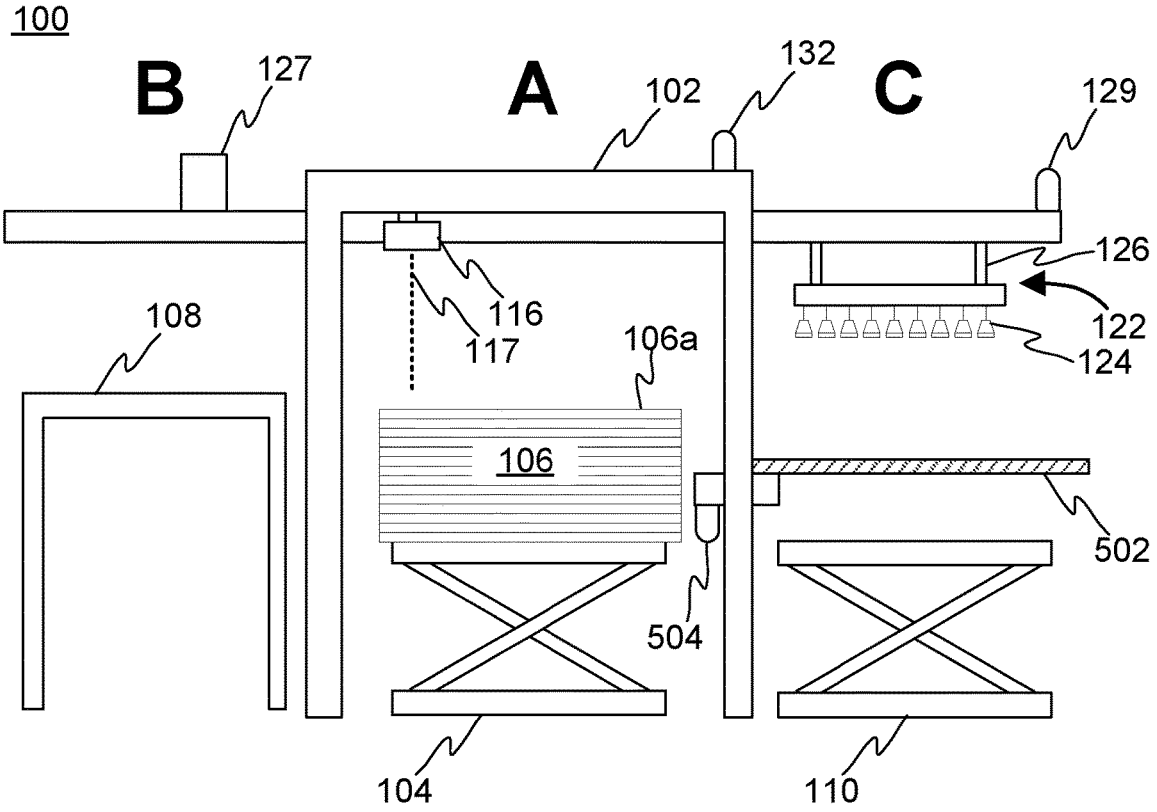
FIGS. 5A-5C illustrate schematically different views of another example of the system according to the invention.
Figure 5B:
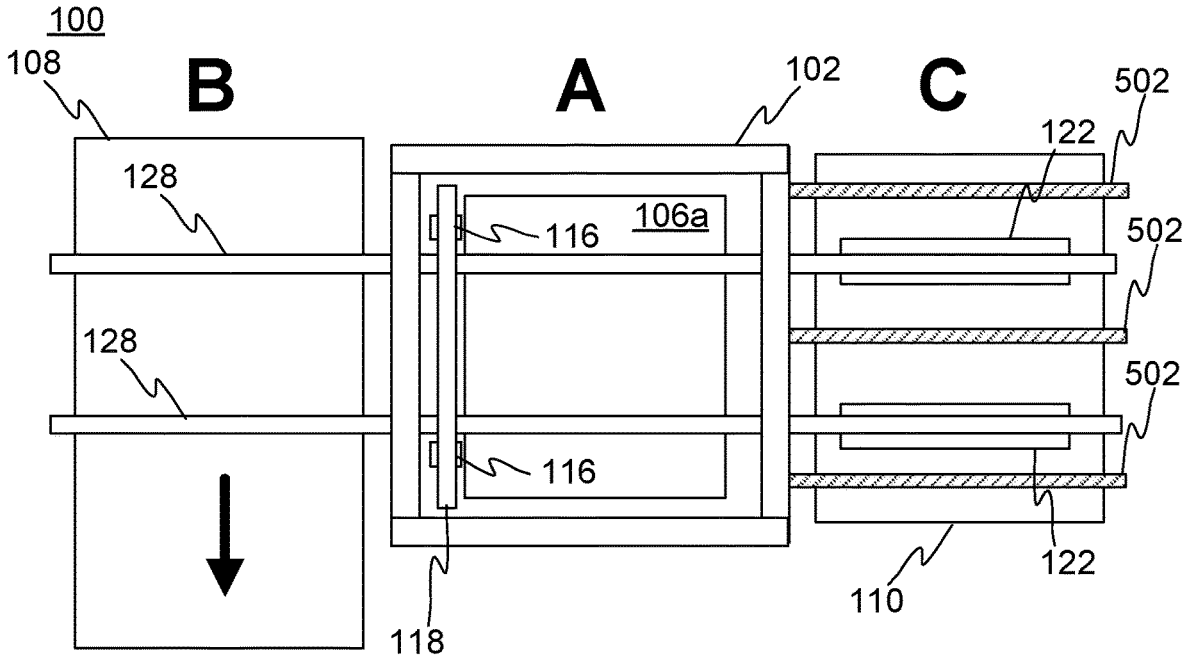

According to an embodiment of the invention the system 100 may further comprise a plurality of accumulator forks 502 configured to receive the veneer sheets transferred to the reject section C. The plurality of accumulator forks 502 may be arranged in parallel above the reject hoisting device 110 of the reject section B. The system 100 according to the invention may further comprise one or more motion generation devices 504, e.g. linear motors or gear motors with an actuator, such as rack and pinion, synchronous belt and pulleys, or roller chain and sprockets, for generating a force causing the movement of the plurality of accumulator forks 502. The plurality of accumulator forks 502 may be arranged parallel to the moving direction of the at least two transfer devices 122. FIG. 5A illustrates schematically a side view of an example system 100 according to the invention comprising the plurality of accumulator forks 502. FIG. 5B illustrates schematically a top view of the example system 100 of FIG. 5A. Above it was discussed that the reject hoisting device 110 receives the veneer sheets transferred to the reject section C. However, if the system 100 comprises the plurality of accumulator forks 502, instead of directly releasing the reject veneer sheets to the reject hoisting device 110, the plurality of accumulator forks 502 may first receive the reject veneer sheets, i.e. the reject veneer sheets may be dropped off onto the plurality of accumulator forks 502. The reject veneer sheets may be cleared off from the plurality of accumulator forks onto the reject hoisting device 110 at an appropriate moment, e.g. when a predetermined amount of reject veneer sheets are transferred to the plurality of accumulator forks 502 and/or according to predetermined clearing schedule. Before dropping off the transferred reject veneer sheet onto the plurality of accumulator forks 502, e.g. one or more sensor devices may be configured to obtain data to determine is the plurality of accumulator forks 502 full, i.e. a predetermined amount of reject veneer sheets has already previously been transferred to the plurality of accumulator forks 502. In response to a determination that the plurality of accumulator forks 503 is not full, the plurality of accumulator forks 502 may be configured to receive the reject veneer sheets transferred to the reject section C, i.e. the control system 114 controls the at least two transfer devices 122 to drop off the reject veneer sheets onto the plurality of accumulator forks 502. Alternatively, in response to a determination that the plurality of accumulator forks 502 is full, the reject hoisting device 110 may be configured to adjust its height in vertical direction so that the top surface of the reject hoisting device 110 is at a stacking height, i.e. at a height at which the reject hoisting device 110 is able to receive the reject veneer sheets from the plurality of accumulator forks 502. According to an exemplifying embodiment of the invention, before adjusting the height of the reject hoisting device 110, the reject veneer sheets transferred to the reject hoisting device 110 previously may be cleared off, e.g. by a forklift. To clear off the reject veneer sheets from the plurality of accumulator forks 502, the plurality of accumulator forks 502 is configured to move, i.e. slide from the reject section C to the feeding section A. The reject hoisting device 110 receives the reject veneer sheets from the plurality of accumulator forks 502 and the plurality of accumulator forks 502 is configured to move, i.e. slide, from the feeding section A back to the reject section C to receive the veneer sheets transferred to the reject section C. During the clearing off the reject veneer sheets from the plurality of accumulator forks 502, the sorting operation may be paused and the feeding hoisting device 104 may be controlled to lower in the vertical direction to enable that the plurality of accumulator forks 502 may slide to the feeding section A over the stack of veneer sheets 106.

Figure 5C:
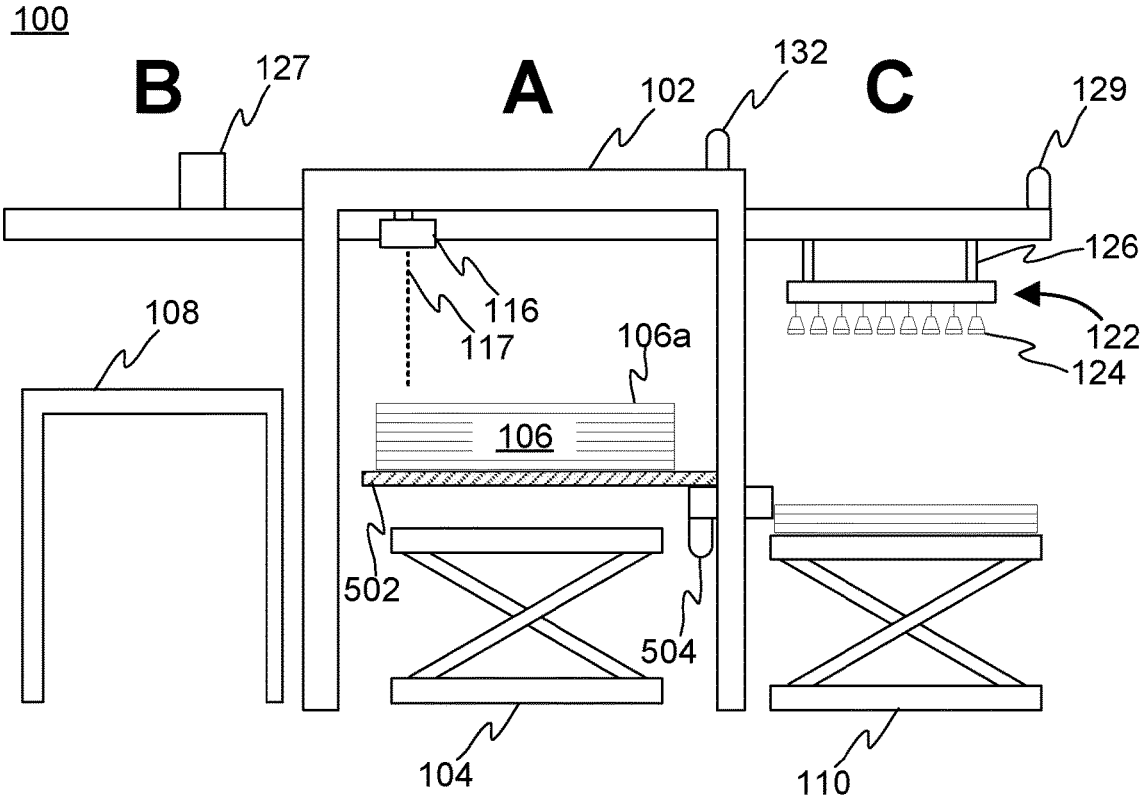

According to an embodiment of the invention, when the amount of the veneer sheets in the stack of veneer sheets 106 on the feeding hoisting device 104 is less than to a predefined limit, the plurality of accumulator forks 502 may be configured to be utilized further to feed the veneer sheets to the sorting operation. The amount of the veneer sheets on the feeding hoisting device 104 may be determined by determining the number of veneer sheets in the stack of veneer sheets 106 or the height of the stack of veneer sheets 106. In response to a determination that amount of the veneer sheets on the feeding hoisting device 104 is more than or equal to the predefined limit, the sorting operation may be continued by feeding the veneer sheets from the feeding hoisting device 104 as described above. If the amount of veneer sheets on the feeding hoisting device 104 is determined based on the number of veneer sheets, the predefined limit may be a predefined number of veneer sheets, such as 20 veneer sheets, preferably 10 veneer sheets. Alternatively. If the amount of veneer sheets is defined based on the height of the stack 106 of the veneer sheets, the predefined limit may be a predefined height of the stack of veneer sheets 106. Alternatively, in response to a determination that the amount of the veneer sheets on the feeding hoisting device 104 is less than the predefined limit, the plurality of accumulator forks 502 may slide from the reject section C to the feeding section A causing that the rejected veneer sheets residing on the plurality of accumulator forks 502 are cleared off from the plurality of accumulator forks 502 onto the reject hoisting device 110 as described above. The plurality of accumulator forks 502 may be configured to receive the remaining stack of veneer sheets 106 from the feeding hoisting device 104. The sorting operation of the veneer sheets as described above may be continued by feeding the veneer sheets from the plurality of accumulator forks 502 instead of the feeding hoisting device 104. FIG. 5C illustrates schematically a side view of an example system 100 according to the invention, wherein the plurality of accumulator forks 502 are configured to carry the remaining stack of veneer sheets 106. The feeding hoisting device 104 may be configured to lower in the vertical direction to receive a new stack of veneer sheets, while the sorting operation continues so that the plurality of accumulator forks 502 is configured to support the stack of veneer sheets 106 in order to feed the veneer sheets to be sorted. When all of the veneer sheets from the stack of veneer sheets 106 on the plurality of accumulator forks 502 are sorted, the accumulator forks 502 may be configured to slide back to the reject section C and the sorting operation continues for the veneer sheets of the new stack of veneer sheets received by the feeding hoisting device 104. The use of accumulator forks 502 enables continuous, i.e. uninterrupted, feeding of veneer sheets to the sorting operation.

Figure 6:
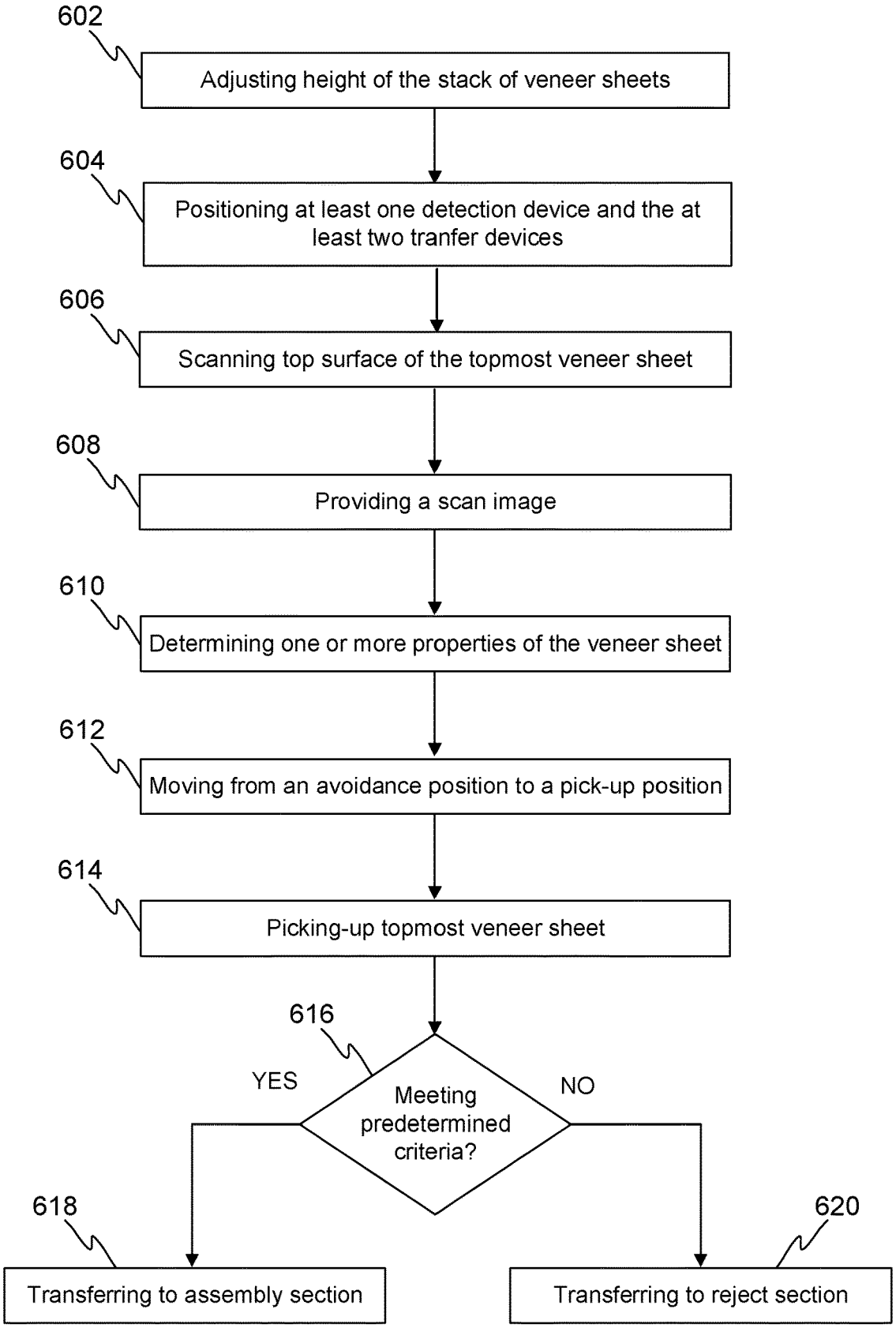
FIG. 6 illustrates schematically an example of a method according to the invention.

The system 100 as described above may be configured to perform a method for sorting one or more veneer sheets one by one. An example of the method according to the invention is next discussed referring to FIG. 6, which illustrates the method steps as a flow chart. As discussed above the feeding hoisting device 104 of the feeding section A receives the stack of veneer sheets 106 to be sorted. At the step 602, the feeding hoisting device 104 adjusts the height of the stack of veneer sheets 106 in the vertical direction so that the top surface of the topmost veneer sheet 106*a* of the stack 106 is at the scanning height. The one or more sensor devices may obtain data to determine at the step 602 that the top surface of the topmost veneer sheet 106*a* of the stack of veneer sheets 106 is at the scanning height as described above.

At a step 604, the at least one detection device 116 is positioned for scanning operation. The at least one detection device 116 is arranged to be located at the reject section C side of the feeding section A causing that an initial moving direction of the at least one detection device 116, i.e. the scanning direction of the topmost veneer sheet 106*a*, may be from the reject section C side of the feeding section A to the assembly section B side of the feeding section A. However, the invention is not limited to that and alternatively the at least one detection device 116 may be arranged to locate at the assembly section B side of the feeding section A causing that the initial moving direction of the at least one detection device 116, i.e. the scanning direction of the topmost veneer sheet 106*a*, may be from the assembly section B side of the feeding section A to the reject section C side of the feeding section A.

Moreover, at the step 604 the at least two transfer devices 122 are positioned at an avoidance position. The avoidance position may be a position, where the at least two transfer devices 122 are away from, i.e. a clear of, a scanning path of the at least one detection device 116. In other words, the avoidance position may be any position, where the at least two transfer devices 122 are not located at the scanning path of the at least one detection device 116 at the same point simultaneously with the at least one detection device 116. This provides a greater view of the top surface of the topmost veneer sheet 106*a* to be scanned for the at least one detection device 116, which enables obtaining wider scan coverage of the top surface of the topmost veneer sheet 106*a* to be scanned. According to an example, the at least two transfer devices 122 may be arranged to the avoidance position locating at the reject section C, i.e. over the reject hoisting device 110. However, this is only one example of the avoidance position of the at least two transfer devices 122 and the invention is not limited to that and any other avoidance position may be used, as long as the at least two transfer devices 122 are clear of the scanning path of the at least one detection device 116.

At the step 606, the at least one detection device 116 scans the top surface of the topmost veneer sheet 106*a* of the stack of veneer sheets 106 to provide the plurality of successive scan lines of the top surface of the topmost veneer sheet 106*a* while moving over the stack of veneer sheets 106 in the horizontal direction between the assembly section B side of the feeding section A and the reject section C side of the feeding section A as described above.

At the step 608 the control system 114 provides the surface scan image from the plurality of successive scan lines provided by the at least one detection device. At the step 610 the control system 114 determines one or more properties of the veneer sheet based on the surface scan image. Moreover, the control system 114 may determine at the step 610 the orientation of the topmost veneer sheet 106*a* based on the surface scan image to define a pick-up position of the veneer sheet, a release position of the veneer sheet, and/or transfer distance between the pick-up position and the release position for the at least two transfer devices 122.

At the step 612 the control system 114 control system controls the at least two transfer devices 122 to move from the avoidance position to the pick-up position determined based on the surface scan image. At a step 614 the control system 114 controls the at least two transfer devices 122 to pick-up the topmost veneer sheet 106*a* of the stack of veneer sheets 106. According to an exemplifying embodiment of the invention, each of the at least two transfer devices 122 may comprise a plurality of suction devices 124 configured to grip to the top surface of the veneer sheet to be transferred by activating one or more of the plurality of suction devices 124. The method may further comprise controlling, by the control system 114, activation and/or deactivation of each of the plurality of the suction devices 124 individually or the plurality of the suction devices 124 in one or more groups as discussed above in the description of the system 100. To pickup the topmost veneer sheet 106*a* at the step 614 the control system 114 controls the one or more actuator devices 126 of the at least two transfer devices 122 to lower the plurality of suction devices 124 in the vertical direction so that the plurality of the suction devices 124 of the at least two transfer devices 122 reach the top surface of the topmost veneer sheet 106*a*. The control system 114 may further control the activation of one or more of the suction devices 124 of the at least two transfer devices 122 so that the one or more suction devices 124 grip to the top surface of the topmost veneer sheet 106*a*. The one or more suction devices 124 of each of the at least two transfer devices 122 required for the transferring operation may be defined based on the surface scan image and the activation of the one or more suction devices 124 may be controlled individually or in groups of suction devices 124 as described above.

According to an exemplifying embodiment of the invention, the method may further comprise at the step 614 determining, by one or more sensor devices, whether the pick-up of the veneer sheet is successful or not as discussed above in the description of the system 100.

At the step 618 the control system 114 controls the at least two transfer devices 122 to transfer the picked-up veneer sheet to the assembly section B in response to detecting at a step 616 that each of the determined one or more properties of the veneer sheet meets a respective predetermined criterion. Alternatively, at the step 620 the control system 114 controls the at least two transfer devices 122 to transfer the picked-up veneer sheet to the reject section C otherwise, i.e. in response to detecting at the step 616 that at least one of the determined one or more properties of the veneer sheet does not meet a respective predetermined criterion. Further aspects relating to the method have been described in the description of the system 100.

A method according to an exemplifying embodiment of the invention may further comprise determining, by the control system 114, an individual pick-up position, an individual release position, and/or an individual transfer distance for each of the at least two transfer devices on the basis of the surface scan image so that the picked-up veneer sheet is aligned to desired orientation as discussed above in the description of the system 100.

A method according to an exemplifying embodiment of the invention may further comprise scanning, by the at least one detection device 116, the subsequent topmost veneer sheet 106*b* of the stack 106 while the at least two transfer devices 122 are transferring the previous topmost veneer sheet 106*a* to the reject section C or to the assembly section B, wherein a scanning direction of a subsequent topmost veneer sheet 106*b* may depend on the direction to which the at least two transfer devices 122 are configured to move to transfer the previous topmost veneer sheet 106*a* as discussed above in the description of the system 100. The control unit 114 may clear the previous scanning results before, starting to scan the subsequent topmost veneer sheet 106*b*.

In a method according to an exemplifying embodiment of the invention, the scanning by the at least one detection device 116 may start outside an edge of the veneer sheet 106*a* and end outside the opposite edge of the veneer sheet 106*a* as discussed above in the description of the system 100.

In a method according to an exemplifying embodiment of the invention, the one or more properties of the veneer sheet may comprise: length; width; and/or number size, and/or form of defects in the veneer sheet as discussed above in the description of the system 100.

Figure 7:
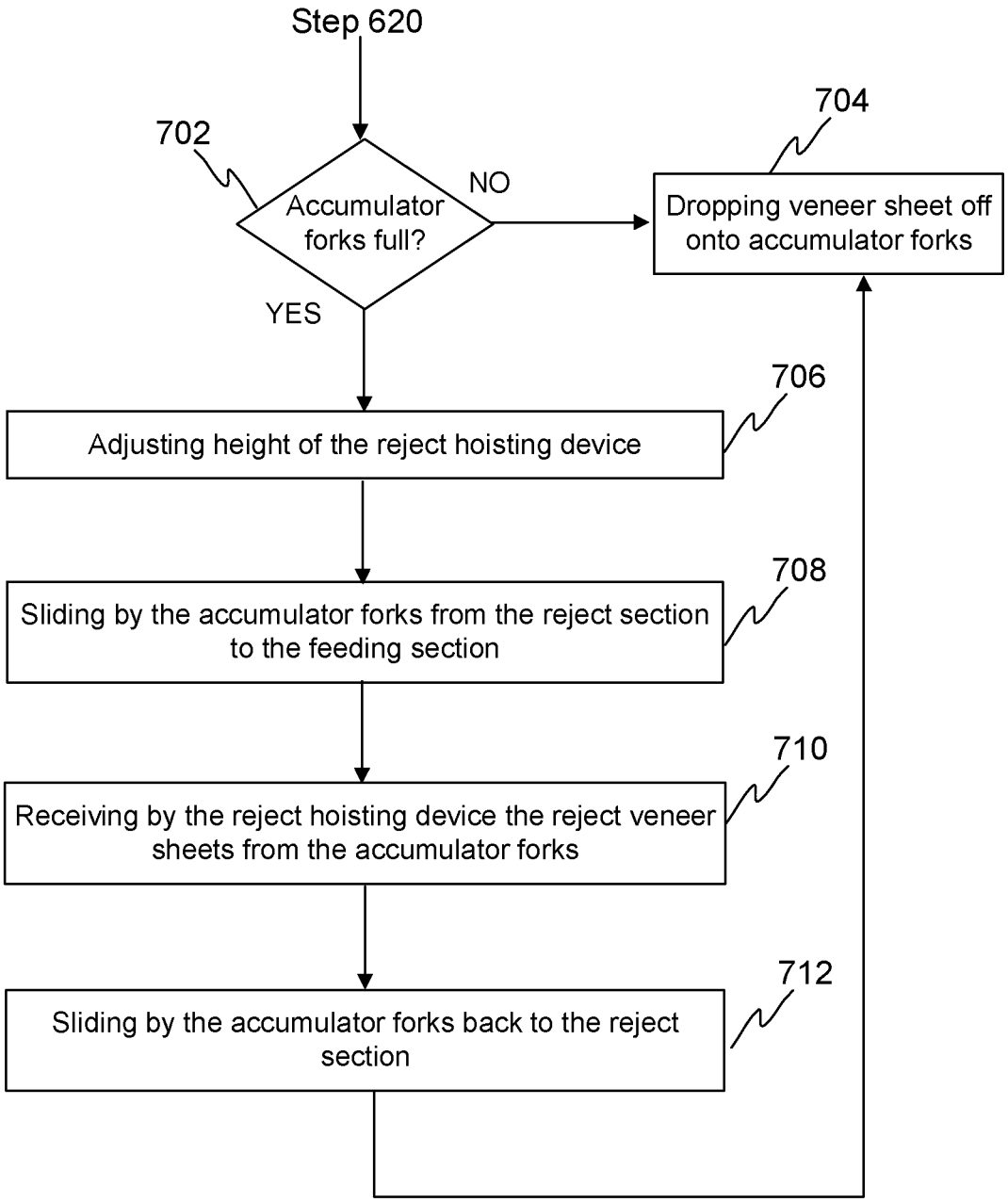
FIG. 7 illustrates schematically another example of a method according to the invention.

A method according to an exemplifying embodiment of the invention is next discussed referring to FIG. 7, which illustrates the method steps as a flow chart. In the example method of FIG. 7 a plurality of accumulator forks 502 arranged in parallel above a reject hoisting device 110 of the reject section C may receive the reject veneer sheets transferred to the reject section C at the step 610, i.e. the reject veneer sheets may be dropped off onto the plurality of accumulator forks 502, instead of directly releasing the reject veneer sheets to the reject hoisting device 110. Before dropping off the transferred reject veneer sheet onto the plurality of accumulator forks 502, at a step 702 it may be determined, e.g. by data obtained by one or more sensor devices, is the plurality of accumulator forks 502 full, i.e.

has a predetermined amount of reject veneer sheets been transferred to the plurality of accumulator forks 502.

In response to a determination that the plurality of accumulator forks 502 is not full at the step 702, the plurality of accumulator forks 502 may receive at a step 704 the reject veneer sheets transferred to the reject section C, i.e. the control system 114 controls the at least two transfer devices 122 to drop off the reject veneer sheets onto the plurality of accumulator forks 502.

In response to a determination that the plurality of accumulator forks 502 is full at the step 702, the reject hoisting device 110 may adjust at a step 706 its height in vertical direction so that the top surface of the reject hoisting device 110 is at a stacking height, i.e. at a height at which the reject hoisting device 110 is able to receive the reject veneer sheets from the plurality of accumulator forks 502. According to an exemplifying embodiment of the invention, before adjusting the height of the reject hoisting device 110, the reject veneer sheets stacked on the reject hoisting device 110 previously may be cleared off, e.g. by a forklift.

At a step 708, the plurality of accumulator forks 502 is moved, i.e. slid, from the reject section C to the feeding section A to clear off the reject veneer sheets from the plurality of accumulator forks 502. At s step 710, the reject hoisting device 110 receives the reject veneer sheets from the plurality of accumulator forks 502. At a step 712, the plurality of accumulator forks 502 is moved, i.e. slid, from the feeding section A back to the reject section C to receive the veneer sheets transferred to the reject section C. During the clearing off the reject veneer sheets from the plurality of accumulator forks 502, i.e. during the steps of 706-712, the sorting operation of the veneer sheets may be paused and the feeding hoisting device 104 may be controlled to lower in the vertical direction to enable that the plurality of accumulator forks 502 may slide to the feeding section A over the stack of veneer sheets 106.

Alternatively or in addition to clearing the reject veneer sheets off from the plurality of accumulator forks 502, when the plurality of accumulator forks 502 is full, the reject veneer sheets may be cleared off from the plurality of accumulator forks 502 onto the reject hoisting device 110 at some other appropriate moment, e.g. according to a predetermined clearing schedule.

Figure 8:
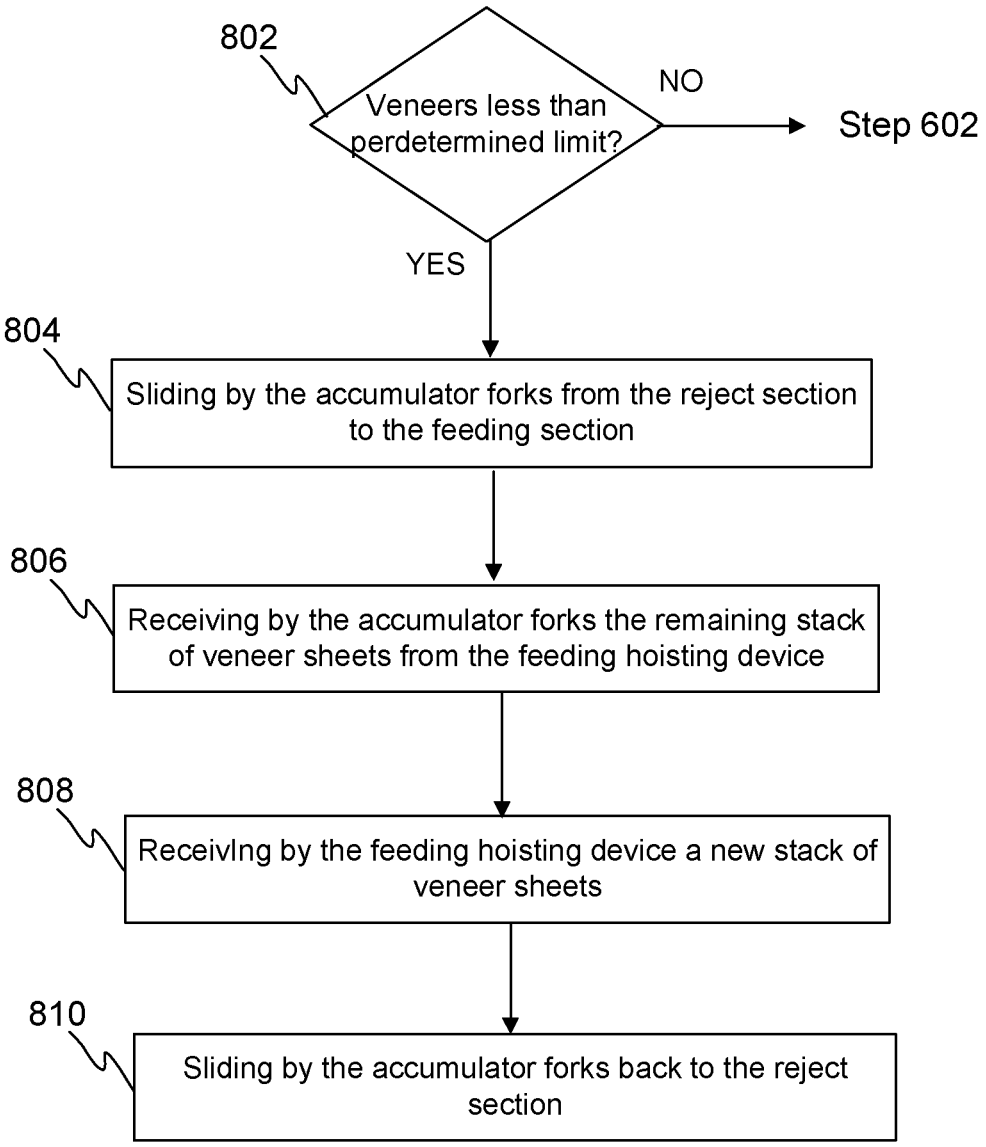
FIG. 8 illustrates schematically another example of a method according to the invention.

A method according to an exemplifying embodiment of the invention is next discussed referring to FIG. 8, which illustrates the method steps as a flow chart. In the example method of FIG. 8, the plurality of accumulator forks 502 arranged in parallel above the reject hoisting device 110 of the reject section C may be utilized further to feed veneer sheets to the sorting operation, when the amount of the veneer sheets in the stack of veneer sheets 106 on the feeding hoisting device 104 is less than a predefined limit as will be described.

At a step 802 the amount of the veneer sheets on the feeding hoisting device 104 may be determined. It may be determined by determining the number of veneer sheets or the height of the stack of veneer sheets 106. In response to a determination that amount of the veneer sheets is more than or equal to a predefined limit at the step 802, the method may continue to the step 602 described above. If the amount of veneer sheets is defined based on the number of veneer sheets at the step 802, the predefined limit may be a predefined number of veneer sheets, such as 20 veneer sheets, preferably 10 veneer sheets. Alternatively, if the amount of veneer sheets is defined based on the height of the stack of veneer sheets 106 at the step 802, the predefined limit may be a predefined height of the stack of veneer sheets 106.

Alternatively, in response to a determination that the amount of the veneer sheets is less than the predefined limit at the step 802, the plurality of accumulator forks 502 may slide from the reject section C to the feeding section A at a step 804 causing that the rejected veneer sheets are cleared off from the plurality of accumulator forks 502 onto the reject hoisting device 110 as described above in the example of FIG. 7.

At a step 806, the plurality of accumulator forks 502 may receive the remaining stack of veneer sheets 106 from the feeding hoisting device 104 and the sorting operation of the veneer sheets according to the method steps 602-620 described above may be continued by feeding the veneer sheets from the plurality of accumulator forks 502 instead of the feeding hoisting device 104. While the sorting operation continues by feeding the veneer sheets from the plurality of accumulator forks 502, the feeding hoisting device 104 may receive a new stack of veneer sheets at a step 808. When all of the veneer sheets from the stack of veneer sheets 106 on the plurality of accumulator forks 502 are sorted, the plurality of accumulator forks 502 may slide back to the reject section C at a step 810 and the sorting operation according to the method steps 602-620 continues for the veneer sheets of the new stack of veneer sheets received by the feeding hoisting device 104. The use of accumulator forks 502 enables continuous, i.e. uninterrupted, feeding of veneer sheets to the sorting operation according to the method steps 602-620.

The specific examples provided in the description given above should not be construed as limiting the applicability and/or the interpretation of the appended claims. Lists and groups of examples provided in the description given above are not exhaustive unless otherwise explicitly stated.

The invention claimed is:

1. A system for sorting veneer sheets, the system comprising:

an assembly section for handling accepted veneer sheets;

a reject section for handling rejected veneer sheets;

a feeding section comprising a feeding hoisting device configured to receive a stack of veneer sheets and to adjust the height of the stack of veneer sheets in the vertical direction so that the top surface of the topmost veneer sheet of the stack is at a scanning height, wherein the feeding section is arranged between the assembly section and the reject section;

at least one detection device configured to scan the top surface of the topmost veneer sheet of the stack of veneer sheets to provide a plurality of successive scan lines of the top surface of the topmost veneer sheet while moving over the stack of veneer sheets in the horizontal direction between the assembly section side of the feeding section and the reject section side of the feeding section;

at least two parallel transfer devices for transferring the topmost veneer sheet from the stack of veneer sheets to the assembly section or to the reject section; and a control system configured to provide a surface scan image from the plurality of successive scan lines provided by the at least one detection device, determine one or more properties of the veneer sheet based on the surface scan image, and to control the at least two transfer devices to:

move from an avoidance position to a pick-up position determined based on the surface scan image, wherein the avoidance position is a position, where the at least two transfer devices are away from a scanning path of the at least one detection device;

pick up the topmost veneer sheet of the stack of veneer sheets; and transfer the picked-up veneer sheet to the assembly section in response to detecting that each of the determined one or more properties of the veneer sheet meets a respective predetermined criterion, or otherwise transfer the picked-up veneer sheet to the reject section.

2. The system according to claim 1, wherein each of the at least two transfer devices comprise a plurality of suction devices configured to grip to the top surface of the veneer sheet to be transferred by activating one or more of the plurality of suction devices, wherein the control system is configured to control activation and/or deactivation of each of the plurality of the suction devices individually or the plurality of the suction devices in one or more groups.

3. The system according to claim 1, wherein an individual pick-up position, an individual release position, and/or an individual transfer distance is determined for each of the at least two transfer devices on the basis of the surface scan image so that the picked-up veneer sheet is aligned to desired orientation.

4. The system according to claim 1, wherein the at least one detection device is configured to scan the subsequent topmost veneer sheet of the stack while the at least two transfer devices are transferring the previous topmost veneer sheet to the reject section or to the assembly section, and wherein a scanning direction of a subsequent topmost veneer sheet depends on the direction to which the at least two transfer devices are configured to move to transfer the previous topmost veneer sheet.

5. The system according to claim 1, wherein the scanning by the at least one detection device starts outside an edge of the veneer sheet and ends outside the opposite edge of the veneer sheet.

6. The system according to claim 1 further comprising one or more sensor devices configured to obtain data to determine that the top surface of the topmost veneer sheet of the stack is at the scanning height and/or to determine whether the pick-up of the veneer sheet is successful or not.

7. The system according to claim 1, wherein the one or more properties of the veneer sheet comprise: length of the veneer sheet; width of the veneer sheet; and/or number, size, and/or form of defects in the veneer sheet.

8. The system according to claim 1 further comprising a plurality of accumulator forks arranged in parallel above a reject hoisting device of the reject section and configured to: receive the veneer sheets transferred to the reject section.

9. The system according to claim 8, wherein before receiving the reject veneer sheets by the plurality of accumulator forks and in response to a determination that a predetermined amount of reject veneer sheets is already transferred to the plurality of accumulator forks, the plurality of accumulator forks is configured to:

slide from the reject section to the feeding section causing that the rejected veneer sheets are cleared off from the plurality of accumulator forks onto the reject hoisting device, and slide, from the feeding section back to the reject section to receive the veneer sheets transferred to the reject section.

10. The system according to claim 8, wherein the plurality of accumulator forks is configured to:

slide from the reject section to the feeding section, when the amount of the veneer sheets on the feeding hoisting device is less than a predefined limit, causing that the rejected veneer sheets are cleared off from the plurality of accumulator forks onto the reject hoisting device, and receive the remaining stack of veneer sheets from the feeding hoisting device, wherein the feeding hoisting device is configured to receive a new stack of veneer sheets, while the plurality of accumulator forks is configured to support the stack of veneer sheets to feed the veneer sheets to be sorted.

11. A method for sorting veneer sheets, the method comprising:

adjusting, by a feeding hoisting device of a feeding section, the height of a stack of veneer sheets in the vertical direction so that the top surface of the topmost veneer sheet of the stack is at a scanning height;

scanning, by at least one detection device, the top surface of the topmost veneer sheet of the stack of veneer sheets to provide a plurality of successive scan lines of the top surface of the topmost veneer sheet while moving over the stack of veneer sheets in the horizontal direction between the assembly section side of the feeding section and the reject section side of the feeding section;

providing, by a control system, a surface scan image from the plurality of successive scan lines provided by the at least one detection device;

determining, by the control system, one or more properties of the veneer sheet based on the surface scan image; and controlling, by the control system, the at least two transfer devices to:

move from an avoidance position to a pick-up position determined based on the surface scan image, wherein the avoidance position is a position, where the at least two transfer devices are away from a scanning path of the at least one detection device;

pick up the topmost veneer sheet of the stack of veneer sheets; and transfer the picked-up veneer sheet to the assembly section in response to detecting that each of the determined one or more properties of the veneer sheet meets a respective predetermined criterion, or otherwise transfer the picked-up veneer sheet to the reject section.

12. The method according to claim 11, wherein each of the at least two transfer devices comprise a plurality of suction devices configured to grip to the top surface of the veneer sheet to be transferred by activating one or more of the plurality of suction devices, wherein the method further comprises controlling, by the control system, activation and/or deactivation of each of the plurality of the suction devices individually or the plurality of the suction devices in one or more groups.

13. The method according to any of claim 11 further comprising determining, by the control system, an individual pick-up position, an individual release position, and/or an individual transfer distance for each of the at least two transfer devices on the basis of the surface scan image so that the picked-up veneer sheet is aligned to desired orientation.

14. The method according to claim any of claim 11 further comprising scanning, by the at least one detection device, the subsequent topmost veneer sheet of the stack while the at least two transfer devices are transferring the previous topmost veneer sheet to the reject section or to the assembly section, and wherein a scanning direction of a subsequent topmost veneer sheet depends on the direction to which the at least two transfer devices are configured to move to transfer the previous topmost veneer sheet.

15. The method according to any of claim 11, wherein the scanning by the at least one detection device starts outside an edge of the veneer sheet and ends outside the opposite edge of the veneer sheet.

16. The method according to any of claim 11 further comprising obtaining, by one or more sensor devices, data to determine that the top surface of the topmost veneer sheet of the stack is at the scanning height and/or determining, by one or more sensor devices, whether the pick-up of the veneer sheet is successful or not.

17. The method according to any of claim 11, wherein the one or more properties of the veneer sheet comprise: length of the veneer sheet; width of the veneer sheet; and/or number size, and/or form of defects in the veneer sheet.

18. The method according to any of claim 11 further comprising receiving, by a plurality of accumulator forks arranged in parallel above a reject hoisting device of the reject section, the veneer sheets transferred to the reject section.

19. The method according to claim 18, wherein before receiving the reject veneer sheets by the plurality of accumulator forks and in response to a determination that a predetermined amount of reject veneer sheets is already transferred to the plurality of accumulator forks, the method further comprising:

sliding, by the plurality of accumulator forks, from the reject section to the feeding section causing that the rejected veneer sheets are cleared off from the plurality of accumulator forks onto the reject hoisting device, and sliding, by the plurality of accumulator forks, from the feeding section back to the reject section to receive the veneer sheets transferred to the reject section.

20. The method according to claim 18 further comprising:

sliding, by the plurality of accumulator forks, from the reject section to the feeding section, when the amount of the veneer sheets on the feeding hoisting device is less than a predefined limit, causing that the rejected veneer sheets are cleared off from the plurality of accumulator forks onto the reject hoisting device;

receiving, by the plurality of accumulator forks, the remaining stack of veneer sheets from the feeding hoisting device; and receiving, by the feeding hoisting device, a new stack of veneer sheets, while the plurality of accumulator forks supports the stack of veneer sheets to feed the veneer sheets to be sorted.

* * * * *